US006260839B1

(12) United States Patent
Araki et al.

(10) Patent No.: US 6,260,839 B1
(45) Date of Patent: Jul. 17, 2001

(54) PAPER FEEDING APPARATUS

(75) Inventors: Takao Araki, Kasuga; Hiroshi Matsumoto, Kurume; Yoshihiro Itoh, Fukuoka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/397,286

(22) Filed: Sep. 16, 1999

(30) Foreign Application Priority Data

| | | |
|---|---|---|
| Sep. 21, 1998 | (JP) | 10-266183 |
| Sep. 21, 1998 | (JP) | 10-266185 |
| Oct. 19, 1998 | (JP) | 10-296373 |
| Dec. 4, 1998 | (JP) | 10-345103 |

(51) Int. Cl.[7] ..... B65H 5/00; B65H 3/52; B65H 1/10; B65H 1/12

(52) U.S. Cl. ..... 271/10.11; 271/121; 271/147; 271/160

(58) Field of Search ..... 271/10.11, 121, 271/122, 124, 125, 147, 160

(56) References Cited

U.S. PATENT DOCUMENTS

| | | | | |
|---|---|---|---|---|
| 4,930,763 | * | 6/1990 | Horii et al. | 271/147 X |
| 5,882,002 | * | 3/1999 | Kamei et al. | 271/118 X |
| 5,995,801 | * | 11/1999 | Katsuta et al. | 271/3.01 X |
| 6,059,280 | * | 5/2000 | Yamauchi et al. | 271/109 X |
| 6,059,281 | * | 5/2000 | Nakamura et al. | 271/119 X |
| 6,129,348 | * | 10/2000 | Park | 271/160 |
| 6,135,443 | * | 10/2000 | Yano | 271/121 X |

* cited by examiner

*Primary Examiner*—Christopher P. Ellis
*Assistant Examiner*—Gene O. Crawford
(74) *Attorney, Agent, or Firm*—Stevens, Davis, Miller & Mosher, LLP

(57) ABSTRACT

The present invention provides a paper feeding apparatus for use in an image reader, e.g. such as an image scanner, which is designed especially to prevent overlap feeding of sheets of paper, and can adjust both the pressing forces between a hopper for carrying sheets of paper in a stacked manner and a pickup roller for paper feeding and between a parting roller and a retard roller for the prevention of overlap feeding. The paper feeding apparatus of the present invention serves to feed the sheets of paper one by one from the hopper and to restrict overlap feeding by the parting roller and the retard roller. This optimizes the paper feeding in the pass line from the hopper to the preventing mechanism for overlap feeding, thereby achieving a secure prevention overlap feeding.

7 Claims, 18 Drawing Sheets

PAPER FEEDING APPARATUS

BACKGROUND OF THE INVENTION

The present invention relates in general to a paper feeding apparatus for an image reader, e.g. such as an image scanner, and more particularly to a paper feeding apparatus ensuring the prevention of overlap feeding of sheets of paper.

The image reader, e.g. such as the image scanner, is provided with a paper feeder for feeding a sheet of paper set up in a hopper onto a pass line communicated to a reading portion. The paper feeder serves to deliver sheets of paper one by one from the top of a stack of the sheets of paper and is usually equipped with a mechanism for preventing overlap feeding of two or more sheets of paper due to the friction between the adjacent sheets. For example, JP-A-4-286558 discloses a paper feeder which is provided with a preventing mechanism of overlap feeding.

FIG. 20 is a schematic view of a main part of the paper feeder under the prior art as an example, which has substantially the same construction disclosed in JP-A-4-286558.

In FIG. 20, disposed on the starting end of the read line is a hopper 51 which is loaded with sheets of paper P such as manuscripts or various documents to be read. A pickup roller 52 is also disposed so as to rotate in contact with the surface of the top of the sheets of paper P. The hopper 51 is forced by a spring 51*a* toward the pickup roller 52 to press the surface of the top of the sheets of paper P against the pickup roller 52, to thereby make it possible to deliver only the top sheet of the paper P by the friction with the peripheral surface of the pickup roller 52.

On the exit side of the pass line from the hopper 51 three-stage conveyance rollers 53, 54 and 55 are arranged, for example, in order to feed the sheet of paper P to the image reading portion. The rollers nip and draw the sheet of paper P fed from the hopper 51 so as to convey them to downstream. Then, on the pass line between the hopper 51 and the first conveyance roller 53 the paper feeder is provided with a parting roller 56 and a retard roller 57 which works as a preventing mechanism of overlap feeding of the sheets of paper P.

The prevention of overlap feeding by means of the parting roller 56 and the retard roller 57 is well known in the field of image readers or copying machines. The retard roller 57 is disposed, by a torque limiter 57*b*, around a spindle 57*a* which rotates by a drive motor, not shown, in the direction indicated by the arrow in the figure. That is, by virtue of the provision of such a torque limiter 57*b*, when one sheet of paper P is delivered from the pickup roller 52 side, the retard roller 57 accepts the rotational torque from the parting roller 56 and then rotates in the conveyance direction of the sheets of paper P. When two sheets of paper P are fed and nipped in an overlapping manner, the retard roller 57 keeps its rotation in the direction indicated by the arrow, to put back the underlying sheet of paper P in an overlapping manner toward the hopper 51.

In addition, it is necessary to allow for the paper sizes from A3 in maximum to B5 in minimum, or smaller size, because the sizes of the sheets of paper P loaded on the hopper 51 are variously different. In cases where the paper feeder allows for various sizes of the sheets of paper P, the weight of the large sized paper P is heavier than the weight of the small sized paper P if both number of sheets of paper P exerted on the hopper 51 are the same. On the other hand, because the spring coefficient of the spring 51*a* is fixed, the large sized paper P makes the pressing force against the pickup roller 52 of the hopper 51 weak due to its heavy weight, whereas a smaller sized paper P tends to cause a stronger pressing force.

Also in the case where the pressing force against the pickup roller 52 varies depending on the size of paper P, an appropriate frictional force should be provided between the sheets of paper and the pickup roller 52, otherwise it is impossible even to deliver the sheet of paper P. For this reason, the spring coefficient of the spring 51*a* should be set so as to secure an appropriate frictional force between the sheets of paper P and the pickup roller 52 necessary for the delivery of the sheet of paper P in the case where a maximum number of maximum sized sheets of paper P are placed on the hopper 51.

In above case, it is possible to deliver the sheet of the paper P by the friction between the sheet of paper P and the peripheral surface of the pickup roller 52, whereas in case that the size of the sheets of paper P is small under above setting of the spring 51*a*, the weight is light, resulting in too strong force of the spring 51*a*. Accordingly, the reacting force by the pickup roller 52 toward the paper P will also increase, so that the friction force increase on not only between the pickup roller 52 and the top sheet of paper P but also between the sheets of paper. As a result overlap feeding of the adjacent sheets of paper P is often caused.

On the other hand, even though overlap feeding of the sheets of paper P has occurred, the parting roller 56 and the retard roller 57 disposed in close vicinity to the hopper 51 are originally expected to prevent overlap feeding by the retard roller 57 putting back the underlying sheet of paper P. However, if the pressing force of the pickup roller 52 against the sheets of paper P is too much excess, it will become difficult to put back the sheet of paper in overlap feeding by the putting back force of the retard roller 57. For this reason, the underlying sheet of paper P in overlap feeding is putted toward the paper feeding direction by the pickup roller 52 while simultaneously it is subjected to putting back force by the retard roller 57. As a result, jamming of the sheet of paper P may occur between the pickup roller 52 and the retard roller 57, making it impossible to deliver the sheets of paper P.

Another condition necessary for the separation of the sheets of paper P when the sheets of paper P are in overlap feeding, is that the critical setting torque of the torque limiter 57*b* is bigger than the sliding friction force between adjacent sheets of paper P. For example, if the sliding friction force between the adjacent sheets of paper exceeds the force of the critical setting torque of the torque limiter 57*b* when in particular the sheets of paper P have a rough quality and therefore the sliding friction coefficient is too big, the retard roller 57 may rotate in the paper feeding direction, disadvantageously permitting the occurrence of overlap feeding without separating the overlapped sheets of paper P.

Further, if the position of the retard roller 57 is fixed relative to the parting roller 56, a substantially constant pressing force is imparted to the sheets of paper P passing therethrough. Then, the frictional force between the contact surfaces of the overlapped sheets of paper P at the time in overlap feeding is substantially proportional to the magnitude of the pressing force by the parting roller 56 and the retard roller 57. Accordingly, under the conditions that the pressing force is strong with rough quality of sheets of paper P for example, the sliding frictional force between the adjacent sheets of paper P is apt to exceed the critical setting torque of the torque limiter 57*b*, resulting in the occurrence of overlap feeding.

SUMMARY OF THE INVENTION

The overlap feeding of the sheets of paper may occur when the pressing force for paper against the pickup roller is inappropriate or nipping force for paper between the parting roller and the retard roller is inappropriate. In addition, the mutual relationship between the pressing force and the nipping force may possibly be attributable to occurrence of the overlap feeding. It is an object of the present invention to provide a paper feeding apparatus ensuring appropriate pressing force and nipping force for all conditions based on combinations of the sizes and qualities of the sheets of paper, thereby to prevent more securely overlap feeding.

The following apparatus is provided under the object.

According to a first aspect, the present invention provides a paper feeding apparatus having a parting roller and a retard roller for preventing overlap feeding, which are disposed in pair above and below a pass line on which sheets of paper are fed one by one in order from the top of a stack of the sheets of paper, the retard roller being provided with a torque limiter between the retard roller and a spindle for driving the retard roller, the torque limiter having a critical torque which is bigger than a sliding friction force between the sheets of paper which are nipped between the parting roller and the retard roller, wherein the paper feeding apparatus comprises a pressing force adjusting device capable of varying the pressing force acting on the sheets of paper which are nipped between the parting roller and the retard roller, by pressing the retard roller toward the parting roller.

According to a second aspect, the present invention provides a paper feeding apparatus having a pickup roller disposed at the starting portion of a pass line on which sheets of paper are fed, a hopper which is disposed below the pickup roller and is operated so as to press the surface of the top of the sheets of paper carried thereon against the peripheral surface of the pickup roller, and an elastic member for pressing the hopper toward the pickup roller, and a pressing force adjusting device capable of varying the pressing force from the elastic means.

According to a third aspect, the present invention provides a paper feeding apparatus having a pickup roller disposed at the starting portion of a pass line on which sheets of paper are fed, a hopper which is disposed below the pickup roller and is operated so as to press the surface of the top of the sheets of paper carried thereon against the peripheral surface of the pickup roller, a pair of guides which can be operated so as to move in the width direction of the hopper in conformity with the size of the sheets of paper carried on the hopper, and an elastic member for pressing said hopper toward said pickup roller, wherein the paper feeding apparatus comprises a pressing force adjusting device capable of adjusting the load acting on the elastic means in conjunction with the movement of the pair of the guides, thereby to vary the pressing force from the elastic means.

According to a third aspect, the present invention provides a paper feeding apparatus having a pickup roller disposed at the starting portion of a pass line on which sheets of paper are fed, a hopper which is disposed below the pickup roller and is operated so as to press the surface of the top of the sheets of paper carried thereon against the peripheral surface of the pickup roller, and a parting roller and a retard roller for preventing overlap feeding, which are disposed above and below a pass line on which said sheets of paper are fed and are at downstream of said pickup roller, wherein the paper feeding apparatus comprises pressing force adjusting means for adjusting the pressing force between the hopper and the pickup roller and the pressing force between the parting roller and the retard roller, the pressing force adjusting means being capable of simultaneously setting the pressing force between the hopper and the pickup roller and the pressing force between the parting roller and the retard roller, in a relation satisfying conditions to feed the sheet of paper and conditions to restrict overlap feeding of two or more sheets of paper.

The paper feeding apparatus according to the first aspect of the present invention prevents securely any possible overlap feeding of the sheets of paper by merely adjusting the pressing force of the retard roller against the parting roller so as to provide a pressing force corresponding to any type of paper having different quality.

The paper feeding apparatus according to the second aspect of the present invention can provide an appropriate pressing force of the pickup roller against the sheets of paper by the pressing force adjusting means, even though the weight on the hopper have variously changed due to the sizes of the sheets of paper. The paper feeding apparatus according to the second aspect of the present invention further provides an appropriate pressing force in conjunction with the guides. It is thereby possible to securely prevent any overlap feeding of the sheets of paper which may often occur when the paper has been changed into small sized one. Then, in the case of using the type having the parting roller and the retard roller for the prevention of overlap feeding at the downstream of the pickup roller, the sheets of paper putted back by the retard roller can rapidly be received in the hopper side to effectively suppress the occurrence of jamming of the sheets of paper.

The paper feeding apparatus according to the third aspect of the present invention can simultaneously adjust the pressing force between the hopper and the pickup roller and the pressing force between the parting roller and the retard roller so as to be able to correspond to different types of the sheets of paper having different weights due to paper size or having different friction coefficient due to quality of paper, thereby making it possible to perform satisfactory paper feeding and to prevent any overlap feeding.

The preferred constructions of the paper feeding apparatus according to the aspects of the present invention will become more apparent from appended claims. The construction of these paper feeding apparatus does not include any complicated mechanisms and is simplified to facilitate any maintenance. Also, the setting of the pressing force corresponding to the type of the sheets of paper in use is feasible only by an external operation, so that it is possible to deal with any change in setting quickly even when quality of paper is changed frequently, thereby a high working efficiency is achieved. Moreover, the sheet being fed by the paper feeding apparatus can be all kind of image carrier sheet not only the sheet of paper.

DESCRIPTION OF THE PREFERRED EMBODIMENTS

The present invention will now be described with reference to the accompanying drawings which illustrate four different embodiments.

Figure 1:
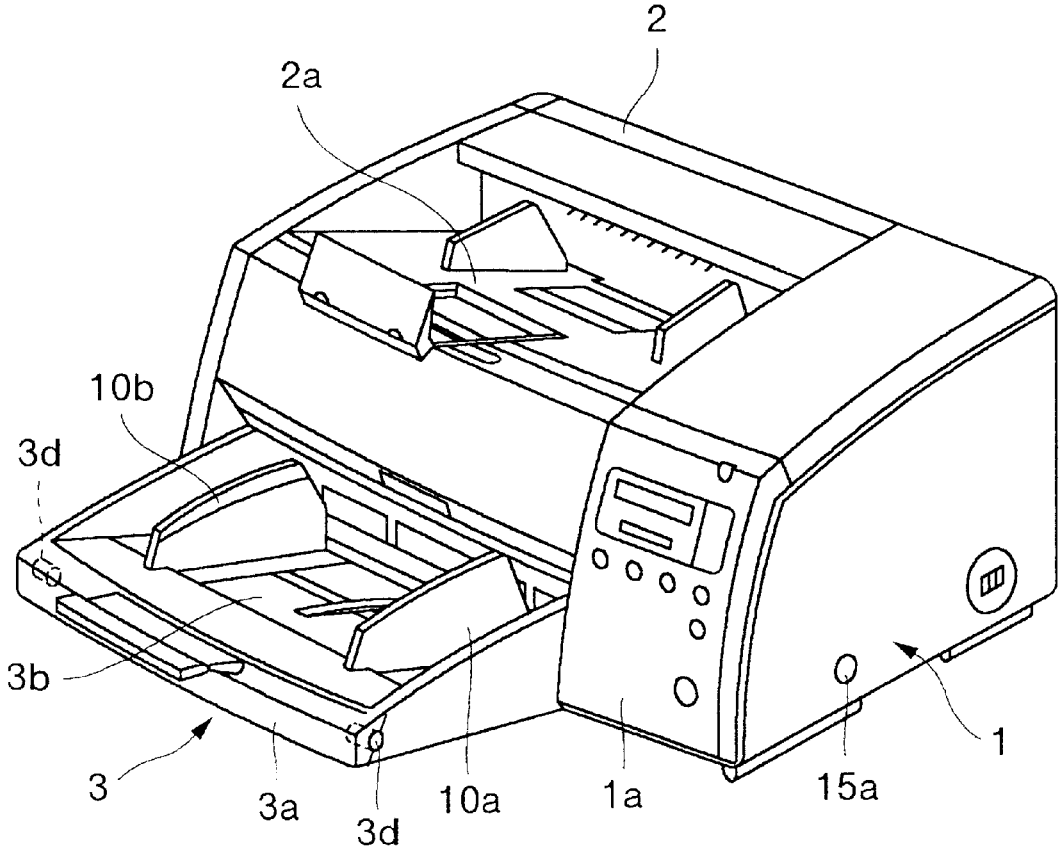
FIG. 1 is an external perspective view of an image scanner equipped with a paper feeding apparatus of the present invention.

In a first embodiment, the image scanner shown in FIG. 1 comprises as exterior members a housing 1 which rises from an operation part 1*a* on the right side when viewed from the front and a sub housing 2 continuous with the operation part 1*a* and positioned on the left side thereof in such a manner as to be able to open up, with a paper feed housing 3*a* being attached on the front side of the housing 1 to the underside of the sub housing 2. The paper feed housing 3*a* is provided with a hopper 3*b* for carrying sheets of paper, the hopper 3*b* being pivoted at its tip end side by a pin 3*d* (see FIG. 2) and being movable at its base end side in the vertical direction. The housing 1 and the sub housing 2 are provided with an image reader in the form of the combination of the paper transport mechanism and an optical system. The sheets of paper fed from the hopper 3*b* are subjected to image reading and thereafter are discharged to the collection tray 2*a* formed on top surface of the sub housing 2.

Figure 2:
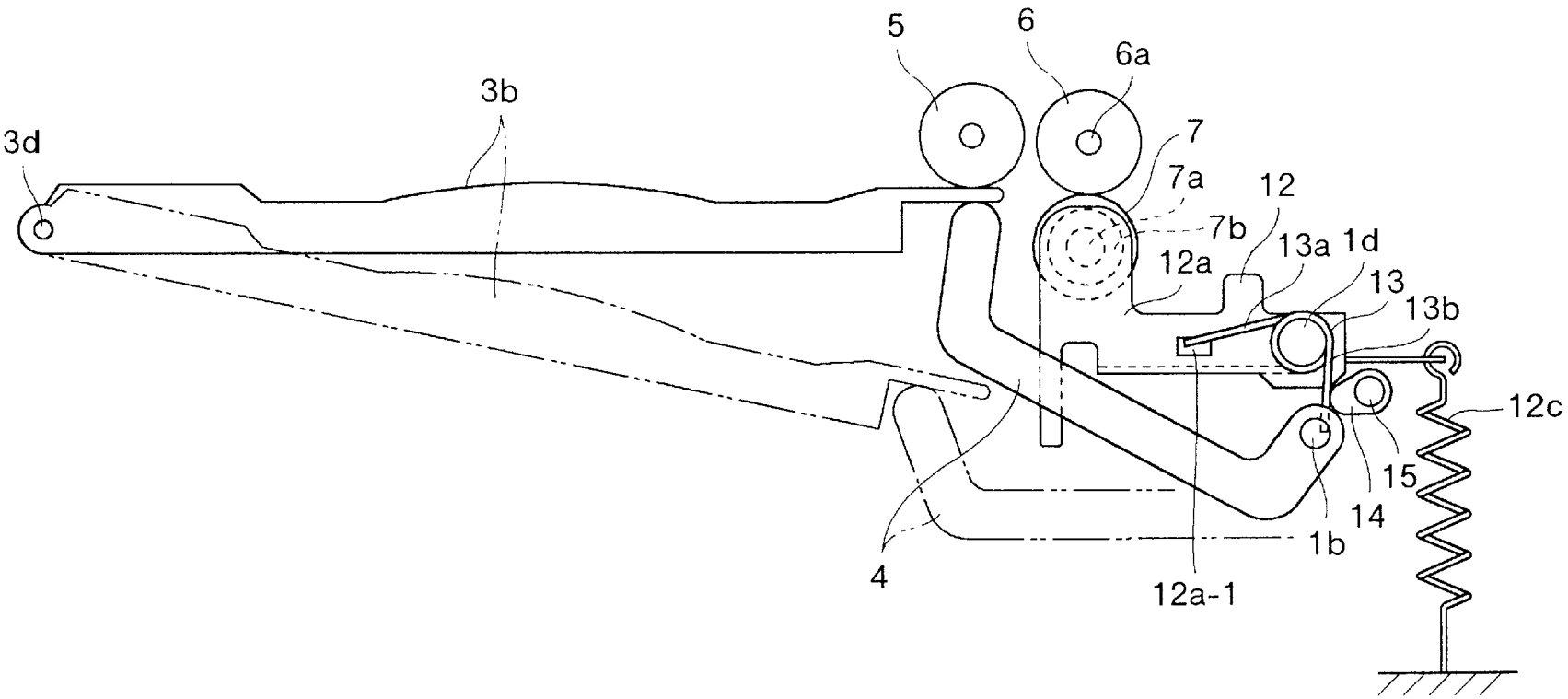
FIG. 2 is a vertical sectional view showing the main part of the paper feeding apparatus of the first embodiment.
Figure 3:
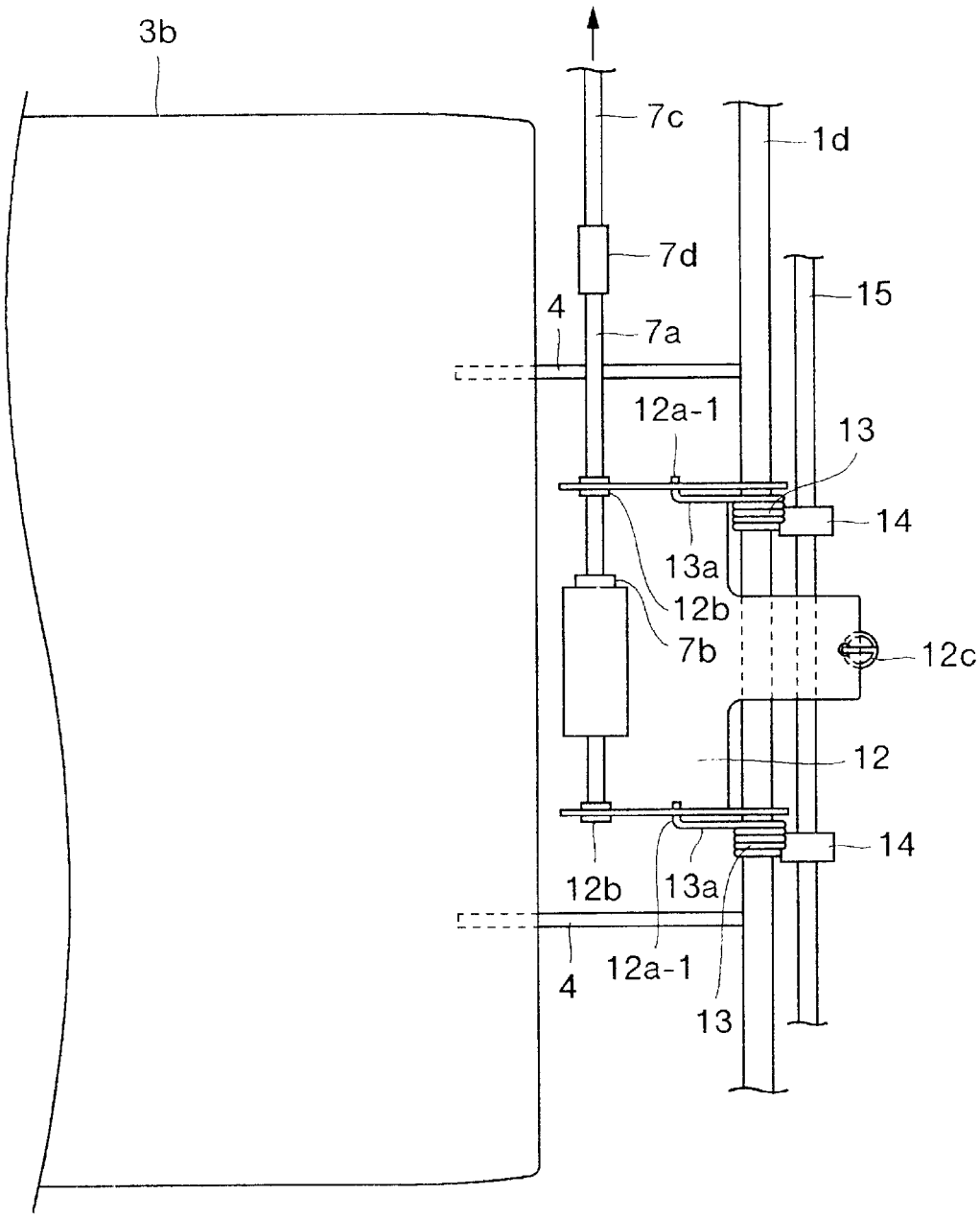
FIG. 3 is a top view of the main part of the paper feeding apparatus of the first embodiment.

In FIGS. 2 and 3, the hopper 3*b* is rotatably connected at its tip end via the pin 3*d* to the paper feed housing 3*a*, and is supported at the bottom surface on the base end side by two arms 4 coupled to the support shaft 1*b* arranged on the bottom side of the housing 1. The support shaft 1*b* coupled to the arms 4 is connected to a hopper motor, not shown, for rotating the support shaft 1*b* such that the rotational drive of the support shaft 1*b* causes the rotation of the arms 4 from the posture indicated by a chain double-dashed line to a solid line in FIG. 2. Then, even when the hopper accepts weight load due to the sheets of paper thereon, the drive of the hopper motor keeps the hopper 3*b* at all times at the posture in which the surface of the topmost layer of the sheets of paper contacts with a pickup roller, which will be described later.

As shown in FIG. 2, the sub housing 2 is provided with a pickup roller 5 located at the position covering the upper surface on the base end side of the hopper 3*b* and a parting roller 6 located at the position somewhat away from the hopper 3*b*. The pickup roller 5 and the parting roller 6 are individually disposed at the center portion in the width direction of the hopper 3*b*, and the drive shaft 6*a* extending through the parting roller 6 is joined to the output shaft of the drive motor, not shown. Then, between the parting roller 6 and the pickup roller 5, a drive system is arranged in the form of a gear train such that the parting roller 6 and the pickup roller 5 can be rotated at the same peripheral speed.

Below the parting roller 6 a retard rollers 7 is disposed for the prevention of overlap feeding under the pass line for sheets of paper fed from the hopper 3*b*. The retard roller 7 is supported on the base 12 which is connected rotatably around the support shaft 1*d* fixed to the bottom side of the housing 1 and comprises a spindle 7*a* supported by a bearing 12*b* provided in a rim 12*a* of the base 12 and a torque limiter 7*b* disposed between the spindle 7*a* and the retard roller 7. Then, the spindle 7*a* is coupled to a transmission shaft 7*c* for connecting to the motor, not shown, for rotationally driving the retard roller 7 via a flexible joint 7*d*. The flexible joint 7*d* is in the form of a tube made of synthetic resin for example, and follows the spindle 7*a* and transmits its rotation even though the spindle 7*a* varies its position in vertical direction relative to the transmission shaft 7*c* fixed in the position.

The base 12 is connected at the one end side to the bottom side of the housing 1 by a tensile coil spring 12*c* which pulls the base 12 so as to rotate around the support shaft 1*d* in the clockwise direction in FIG. 2. Accordingly, the retard roller 7 is kept at the state in which it is pressed against a parting roller 6 by a certain constant pressing force corresponding to the tensile force of the coil spring 12*c*. Then, FIG. 4 shows the structure of connection of the base 12 to the support shaft 1*d* and the schematic of the main part of the retard roller 7.

Figure 4:
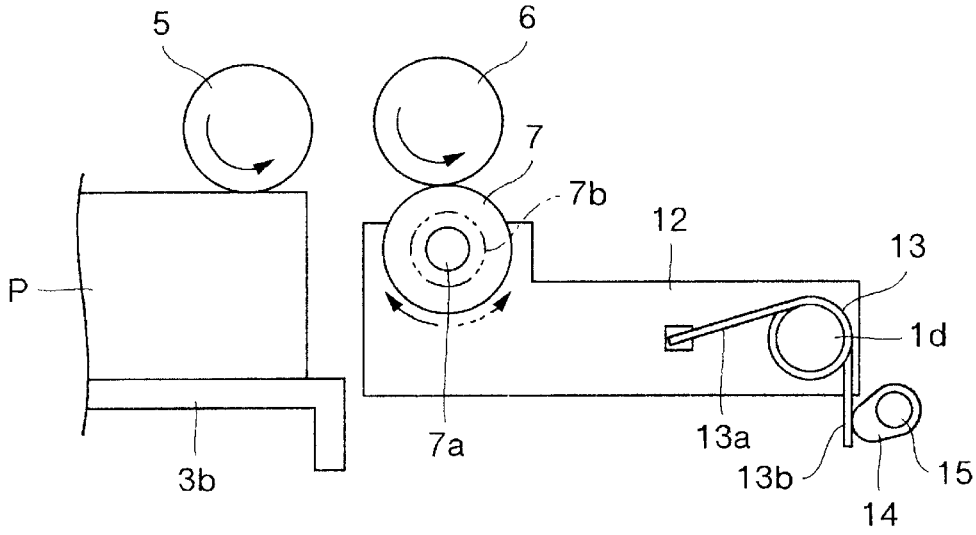
FIG. 4 is a schematic view of a mechanism for setting a pressing force between the parting roller and the retard roller in the first embodiment.

The function of the torque limiter 7*b* connected between the retard roller 7 and the spindle 7*a* is the same as set forth in the description of the prior art, and the spindle 7*a* usually rotates in the counterclockwise direction in FIG. 4. Then, when the torque on the retard roller is not more than the critical setting torque of the torque limiter 7*b*, that is, when there is any overlap feeding of the sheets of paper P, the retard roller 7 rotates together with the spindle 7*a* to put back the sheet of paper P toward the hopper 3*b*, whereas when no overlap feeding is found, that is, when the torque on the retard roller equal to or more than the critical setting torque is applied, it reversely rotates in the clockwise direction indicated by a solid line in FIG. 4.

The base 12 retaining the retard roller 7 is provided with two torsion springs 13 in the form of torsion coil springs inserted around the support shaft 1*d*, the torsion springs forcing the base 12 in the clockwise direction in FIG. 4. The torsion spring 13 comprises two hooks 13*a* and 13*b* which are both ends in the winding direction protruding in the tangential direction from the peripheral surface of the windings. The hook 13*a* on the one end side is inserted into the engagement hole 12*a*, as shown in FIG. 2, which is provided in a rim 12*a* of the base 12, and the hook 13*b* on the other end side is a free end. Then, the hook 13*b* in the form of the free end is provided in contact with a cam 14 for adjusting the biasing force of the torsion spring 13.

The cam 14 is fixed to the adjusting shaft 15 provided in the housing 1 in its width direction, and a adjusting dial 15*a* is mounted on one end of the adjusting shaft 15 and is on the side surface of the housing 1 as shown in FIG. 1. The outline of the cam 14 is acircular form offset relative to the adjusting shaft 15 as shown in FIG. 2 and pushes the hook 13*b* toward the direction tightening the torsion spring 13 in its winding direction. Then, by turning the adjusting dial 15*a*, it is possible to change the position of the peripheral surface of the cam 14 abutting against the hook 13*b* and thereby to adjust the tightening degree of the torsion spring 13 in the winding direction.

Figure 5A:
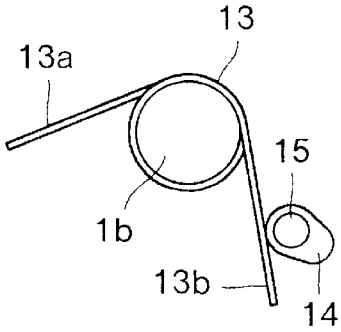
FIGS. 5A, 5B and 5C are schematic views showing the setting of the pressing force of the torsion spring which corresponds to the posture of the cam in the first embodiment.
Figure 5B:
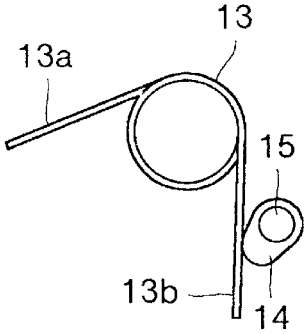

In FIG. 5A, the peripheral surface of the cam 14 closest to the center of the adjusting shaft 15 abuts against the hook 13*b*, and the tightening degree of the hook 13*b* in the winding direction is substantially zero so that the biasing force by the torsion spring 13 does not act on the base 12. FIG. 5B shows the state where the adjusting shaft 15 is rotated through about 90 degrees in the clockwise direction from FIG. 5A, with the biasing force of the torsion spring 13 being set to the intermediate value or its vicinity. Further, FIG. 5C shows the state in which the peripheral surface of the cam farthest away from the center of the adjusting shaft 15 abuts thereagainst through an additional 90 degree rotation from FIG. 5B, so that the biasing force of the torsion spring is set to the maximum value.

In the above construction, when the pickup roller 5 and the parting roller 6 are rotationally driven, the topmost one of the sheets of paper P mounted on the hopper 3*b* is delivered by the frictional force with the pickup roller 5 in the same manner as in the prior art example. Then, the parting roller 6 and the retard roller 7 cooperates in pair, and the conveyance of the sheet of paper and the putting back of the overlapping sheet of paper are carried out by the function of the torque limiter 7*b* as set forth hereinabove.

Figure 5C:
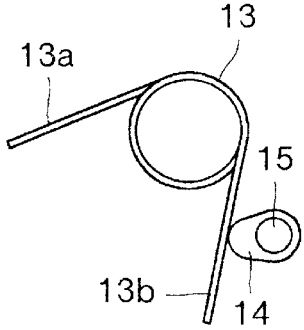

As set forth in FIGS. 5A to 5C, the rotational operation of the adjusting dial 15*a* causes a change in the posture of the cam 14, which results in a change of the biasing force of the torsion spring 13. Then, the biasing force of the torsion spring 13 acts in the direction causing the base 12 to rotate upward. Thus, the pressing force can be varied on the sheet of paper P nipped between the retard roller 7 retained by the base 12 and the parting roller 6 on the side of sub housing 2 side.

In this case, the conditions for ensuring correct action of the paper P separating function by the parting roller 6 and the retard roller 7 are as follows. In the following conditional expressions, F is a pressing force of the retard roller 7, T is a critical setting torque of the torque limiter 7*b*, r is a radius of the retard roller 7, and the weight of the paper P is negligible.

(1) When no sheets of paper P lie between the parting roller 6 and the retard roller 7, the retard roller 7 comes into contact with the parting roller 6 and rotate together. That is, the retard roller 7 rotates in the counterclockwise direction indicated by the solid line in FIG. 4. The condition therefor is $\mu_0 \cdot F > T/r$ where the coefficient of friction between the parting roller 6 and the retard roller 7 is $\mu_0$.

(2) When only one sheet of paper P lies between the parting roller 6 and the retard roller 7, i) no slippage occurs between the parting roller 6 and the sheet of paper P, so that the sheet of paper P is fed forward, while simultaneously (ii) there is no slippage between the retard roller 7 and the sheet of paper P so that the retard roller rotates with the parting roller 6 for the feed of the sheet of paper P. The condition for (i) is therefore $\mu_1 \cdot F > T/r$ and the condition for (ii) is $\mu_2 \cdot F > T/r$ where $\mu_1$ is a coefficient of friction between the parting roller 6 and the sheet of paper P, and $\mu_2$ is a coefficient of friction between the retard roller 7 and the sheet of paper P.

(3) When two sheets of paper P lie between the parting roller 6 and the retard roller 7, the sheet of paper P are returned toward the hopper 3*b* with the retard roller 7 contacted by the paper P against the frictional force exerted between the two adjacent sheets of paper P. The condition therefor is $\mu_3 \cdot F < T/r$ where $\mu_3$ is a coefficient of friction between the two adjacent sheets of paper P.

In the above conditional expressions, the critical setting torque T of the torque limiter 7*b* and the radius r of the retard roller 7 are fixed values, and the coefficient of friction $\mu_0$ is a constant determined by the parting roller 6 and the retard roller 7. Also, the coefficients of friction $\mu_1$, $\mu_2$ and $\mu_3$ are fixed values determined by the type of the sheets of paper P. On the other hand, the sheets of paper P used are of various types, so that F can be set so as to satisfy all of the above $\mu_0 \cdot F > T/r$, $\mu_1 \cdot F > T/r$, $\mu_2 \cdot F > T/r$ and $\mu_3 \cdot F < T/r$ in compliance with the types of the sheets of paper, thereby to ensure secured operation of the separation function. That is, the pressing force F of the retard roller 7 can be set in accordance with the types of the sheets of paper P by adjusting the biasing force of the torsion spring 13 through the posture of the cam 14.

In this manner, if the quality of the paper P is recognized in advance, it will suffice to adjust the biasing force of the torsion spring 13 by the adjusting dial 15*a* so as to provide a pressing force F in compliance with the quality of paper, thereby making it possible to securely prevent any overlap feeding of various types of paper P having different coefficients of paper.

In a second embodiment, the image scanner shown in FIG. 1 comprises, as exterior members, a housing 1 which rises from an operation part 1*a* on the right side when viewed from the front and a sub housing 2 continuous with the operation part 1*a* and positioned on the left side thereof in such a manner as to be able to open up, with a paper feed unit 3 for carrying documents such as sheets of paper being attached on the front side of the housing 1 at the underside of the sub housing 2. The housing 1 and the sub housing 2 are provided with an image reader in the form of the combination of the paper transport mechanism and an optical system. The sheets of paper fed from the paper feed unit 3 are subjected to image reading and thereafter are discharged to the collection tray 2*a* formed on top surface of the sub housing 2.

The paper feed unit 3 comprises a frame 3*a* fixed to the housing 1 and a hopper 3*b* housed in the frame 3*a* for carrying sheets of paper, the hopper 3*b* including a pair of side guides 10*a* and 10*b* which can vary a distance between them in correspondence with the size of the sheets of paper. Then, the hopper 3*b* is pivotally attached at its both end on the tip side thereof to the frame 3*a*, with the free end on the base side thereof being rotatable in vertical direction. That is, the frame 3*a* is kept at its posture fixed to the housing 1 shown in FIG. 1, and within the frame 3*a* the hopper 3*b* is assembled to the housing 1 in such a manner that its base end is freely movable vertically.

Figure 6:
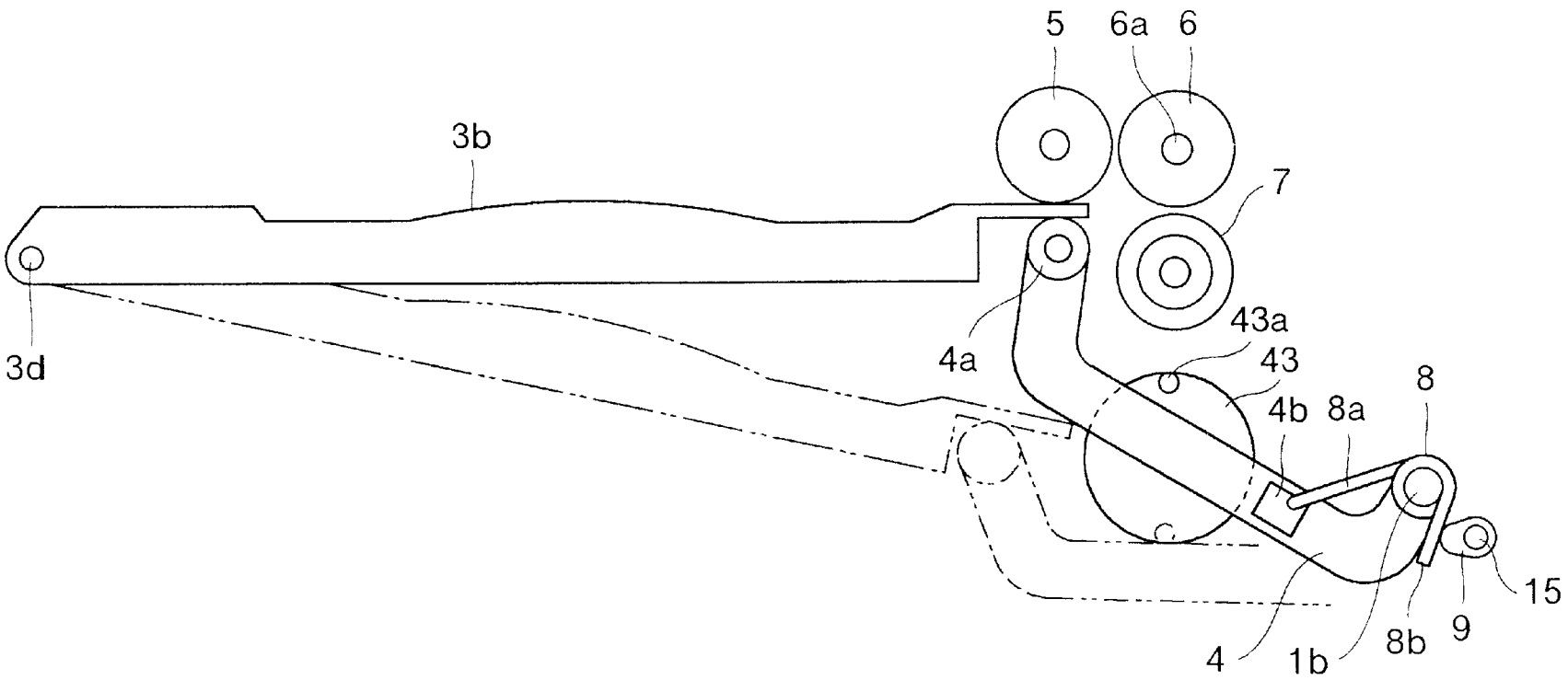
FIG. 6 is a vertical sectional view of the main part of the paper feeding apparatus of the second embodiment.
Figure 7:
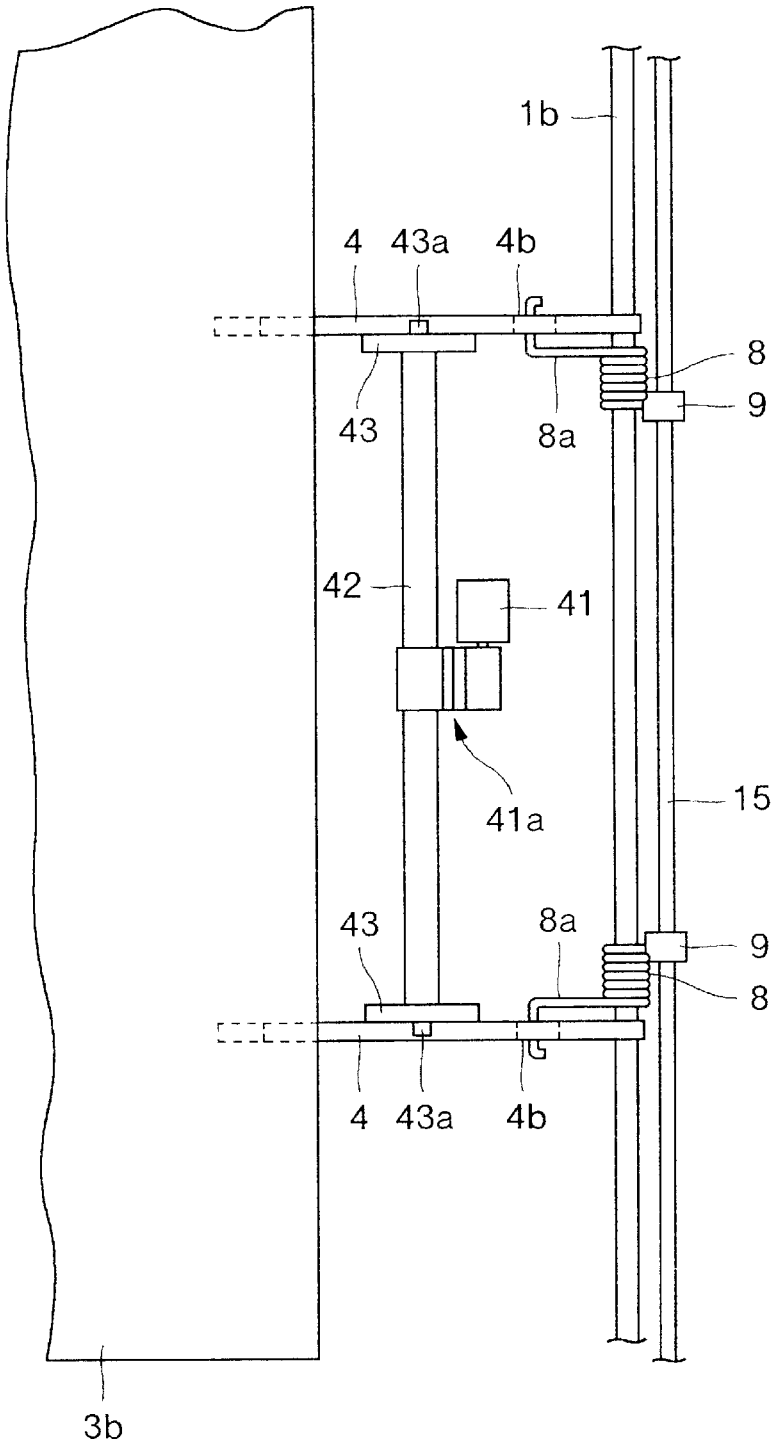
FIG. 7 is a top view of the main part of the paper feeding apparatus of the second embodiment.

In FIGS. 6 and 7, two arms 4 are rotatably attached around the support shaft 1*b* fixed to the interior of the housing 1, and the tip ends of the arms 4 are mounted rotatably with a support roller 4*a* for carrying the bottom surface of the hopper 3*b* on the base end thereof. On the other hand, the hopper 3*b* is rotatably connected at its tip to the frame 3*a* by way of a pin 3*d*. Accordingly, when the arm 4 is rotated from the position indicated by a chain dotted line to the posture shown in a solid line in FIG. 6, the support roller 4*a* carrying the hopper 3*b* at its base end lifts the hopper with the rotation thereof. Further, when the arm 4 is turned in the counter-clockwise direction in FIG. 6, the hopper 3*b* lowers at its base end and is set to the posture indicated by the chain dotted line in the Figure.

The sub housing 2 accommodates a pickup roller 5 located at the position covering the upper surface of the hopper 3*b* on its base end side and a parting roller 6 located at the position somewhat away from the hopper 3*b*. The pickup roller 5 and the parting roller 6 are individually disposed at the central portion in the width direction of the hopper 3*b*, and the drive shaft 6*a* extending through the parting roller 6 is joined to the output shaft of the drive motor, not shown. Then, between the parting roller 6 and the pickup roller 5 there is interposed a drive system in the form of a gear train such that the parting roller 6 and the pickup roller 5 can be rotated at the same peripheral speed.

Further, below the parting roller 6 there is disposed retard rollers 7 for the prevention of overlap feeding at both sides of the pass line for the sheets of paper fed from the hopper 3*b*. The retard roller 7 is provided with a torque limiter, and as well known in the prior art, continues to rotate in the direction putting back the sheets of paper toward the hopper 3*b* when the torque on the retard roller is not more than the critical setting torque of the torque limiter, in other words, when there is any overlap feeding, but on the contrary it reversely rotates in the paper feed direction when a load equal to or more than the critical setting torque is applied without any overlap feeding of sheets of paper.

In order to ensure that the topmost one of the sheets of paper mounted on the hopper 3*b* comes into contact with the pickup roller 5 and is delivered by its frictional force, a torsion spring 8 intervenes between the periphery of the support shaft 1*b* and the arm 4. The torsion spring 8 can be a torsion coil spring.

As shown in FIG. 6, the torsion spring 8 comprises two hooks 8*a* and 8*b* which are both ends of the torsion spring in the winding direction protruding in the tangential direction from the peripheral surface of the windings. The hook 8*a* on the one end side is inserted into the engagement hole 4*b* provided in the arm 4, and the hook 8*b* on the other end side is a free end. A cam 9 is disposed to come into contact with the hook 8*b* which is the free end, the cam 9 adjusting the resilient biasing force of the torsion spring 8.

The cam 9 is fixed to the adjusting shaft 15 provided in the housing 1 in its width direction, and a adjusting dial 15*a* is mounted on one end of the adjusting shaft 15 and is on the side surface of the housing 1 as shown in FIG. 1. The outline of the cam 9, as shown in FIG. 6, is an circular surface having a substantially elliptical form offset relative to the adjusting shaft 15 and pushes the hook 8*b* toward the direction tightening the torsion spring 8 in its winding direction. Then, by turning the adjusting dial 15*a*, it is possible to change the position of the peripheral surface of the cam 9 abutting against the hook 8*b* and thereby to adjust the tightening degree of the torsion spring 8 in the winding direction.

On the other hand, a drive motor 41 is disposed as shown in FIG. 7 so as to provide a drive mechanism for pressing down the arm 4 against the upward biasing force of the arm 4 exerted by the torsion spring 8. The output shaft of the drive motor 41 is connected via a gear train 41*a* to a transmission shaft 42 having an axis parallel to the support shaft 1*b*, and the both ends of the transmission shaft 42 in the axial direction is amounted with two flanges of a disk shape. The two flanges 43 confront each arm 4 as shown in FIG. 7 and each have a boss 43*a* abutting against the upper surface of the arm 4 according to the rotational posture of the flange 43, the boss 43*a* projecting from the proximity on the outer periphery of the flange 43.

Figure 8A:
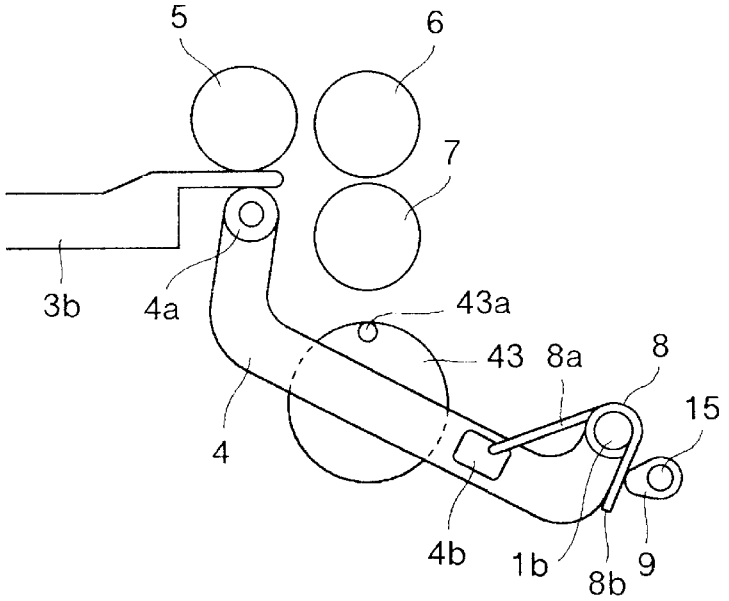
FIGS. 8A and 8B are schematic views showing the relation between the position of the boss and the posture of the arms in the second embodiment.
Figure 8B:
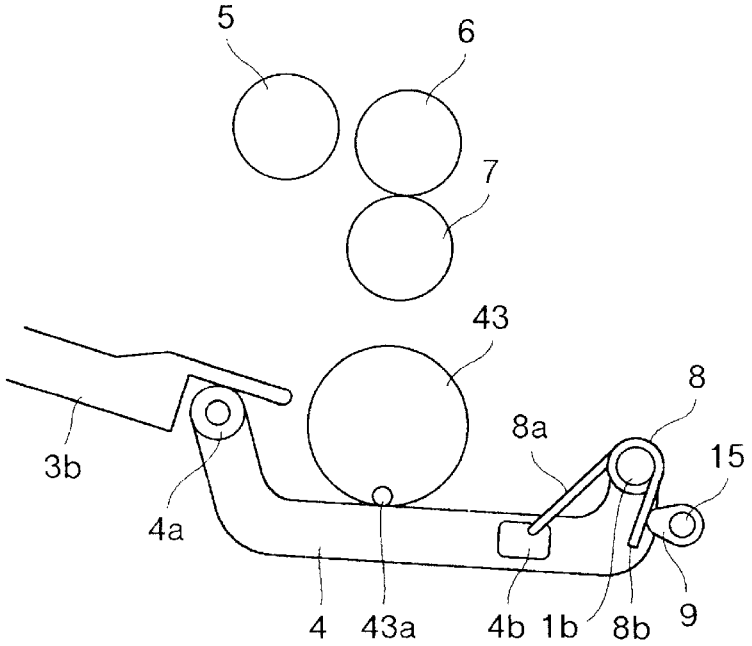

FIGS. 8A and 8B are schematic Figures showing a relationship between the position of the boss and the setting of the posture of the arm. In FIG. 8A, the boss 43*a* is apart from the upper surface of the arm 4. Thus, there is no restraint of the arm 4 in the downward direction, and the arm 4 turns in the clockwise direction around the support shaft 1*b* by the biasing force of the torsion spring 8, allowing the upper surface of the base end of the hopper 3*b* to come nearest to the pickup roller 5. On the contrary, when the flange 43 is turned by the drive motor 41, the boss 43*a* comes to abut against the upper surface of the arm 4 whereby the arm 4 is pushed downward by the boss 43*a*. Then, when the boss 43*a* is located at its lowest position, as shown in FIG. 8B, the arm 4 assumes its substantially horizontal posture and the hopper 3*b* assumes the inclined posture as indicated by the chain dotted line shown in FIG. 6.

Figure 9A:
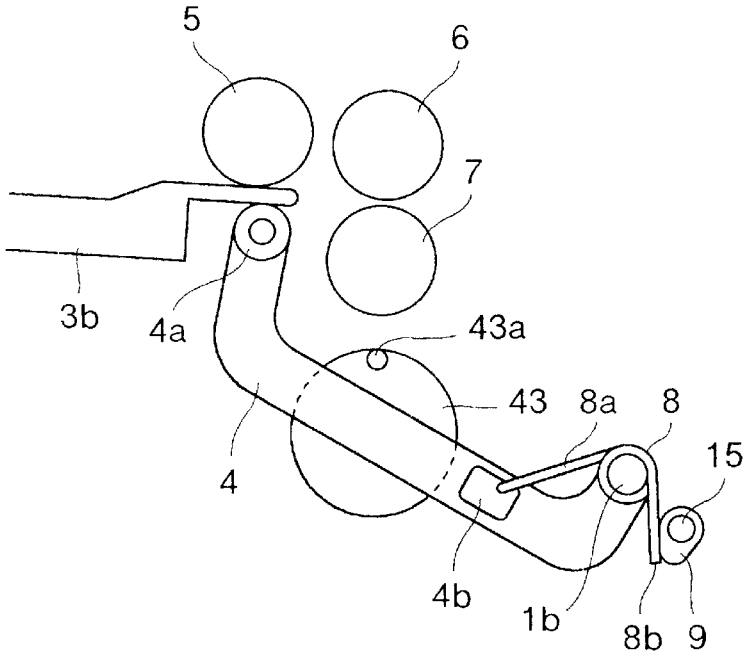
FIGS. 9A and 9B are schematic views showing the setting of the pressing force for the arm which corresponds to the posture of the cam in the second embodiment.
Figure 9B:
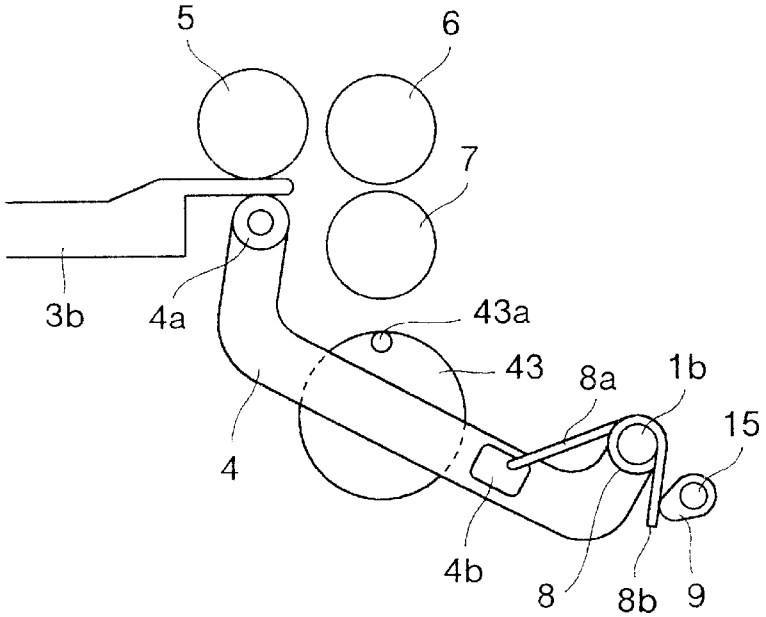

FIGS. 9A and 9B are schematic Figures showing the adjustment of the biasing force by the posture of the cam.

In FIG. 9A, the peripheral surface of the cam closest to the center of the adjusting shaft 15 abuts against the hook 8*b*, and the tightening degree of the hook 8*b* in the winding direction is minimum and the biasing force by the torsion spring 8 is weak. FIG. 9B shows the state in which the adjusting shaft 15 is turned by about 45 degrees in the clockwise direction from FIG. 9A, and the biasing force of the torsion spring is set to the intermediate value or its vicinity. Then, as shown in FIG. 8B for example, when the adjusting shaft 15 is further turned by about 45 degrees from FIG. 9B, the peripheral surface of the cam 9 remotest from the center of the support shaft 1*b* abuts against the hook 8*b*, and the biasing force of the torsion spring 8 is set to its maximum.

In this manner, by rotationally operating of the adjusting shaft 15, it is possible to vary the biasing force of the torsion spring in a stepless manner and to adjust the pressing force of the hopper 3*b* whose based end is carried by the support roller 4*a* of the arm 4 toward the pickup roller 5.

In the above construction, when the pickup roller 5 and the parting roller 6 are driven in rotation, the topmost sheet of paper mounted on the hopper 3*b* is delivered by the frictional force relative to the pickup roller 5 in the same manner as in the prior art. Then, the parting roller 6 and the retard roller 7 cooperate in pair to perform the transport of the sheets of paper or the putting back the one in the overlap feeding by function of the torque limiter as set forth hereinabove.

Herein, the hopper 3*b* of the paper feed unit 3 has different carrying load depending on the size of the sheets of paper as described above. That is, if a pressing force of the sheets of paper against the pickup roller 5 is too large, the paper is not only apt to be delivered in the overlapping manner but also the overlapping sheet returning function of the retard roller 7 may be impaired.

On the contrary, in the present invention, the posture of the cam 9 is varied by the rotational operation of the adjusting dial 15*a* whereby the biasing force of the torsion spring 8 can be varied as shown in FIGS. 9A and 9B. Then the biasing force of the torsion spring 8 acts in the direction allowing the tip of the arm 4 to rotate upward so that the pressing force can be adjusted between the sheets of paper on the hopper 3*b* and the pickup roller 5.

For example, if the size of the sheets of paper is large, the carrying load imparted to the hopper is also large, resulting in a stronger force pressing down the hopper around the pin 3*d*. Thus, in order to bias the hopper 3*b* upward against the pressing down force to thereby compensate for the pressing force imparted to the pickup roller 5, the biasing force of the torsion spring 8 is set to a larger value with the cam 9 being in the posture shown in FIG. 9B. As a result, regardless of the large paper carrying load, the biasing force of the torsion spring 8 is transmitted via the arm 4 to the hopper 3*b* so that the sheets of paper P on the hopper 3*b* can abut against the pickup roller 5 in an appropriate pressing force.

Further, if the size of the sheets of paper is small and its carrying load is also small, the adjusting dial 15*a* is turned so as to provide the posture of the cam 9 shown in FIG. 9A to thereby reduce the biasing force of the torsion spring 8. Therefore, when the size of sheets of paper for the image reading is changed from the large one to the small one, the change of the posture of the cam 9 will ensure an appropriate switching to the biasing force depending on the carrying load of the small sized sheets of paper, although the posture of the cam 9 of FIG. 9B would cause an excess biasing force.

In this manner, by virtue of the fact that the biasing force of the torsion spring 8 can be increased or reduced in response to the size of the sheets of paper mounted on the hopper 3*b*, the contact pressure between the pickup roller 5 and the sheets of paper can be set to the appropriate value, thereby providing an effective prevention of the overlapping caused by the pickup roller 5. Then, by optimizing the biasing force of the torsion spring 8, the pressing reaction force from the pickup roller 5 can be suppressed to such a degree not as to interfere with the paper returning force exerted by the retard roller 7. Accordingly, even though any overlapping fed has occurred under the influence of types of paper, humidity and the like, the upper sheet of paper in the overlap feeding is only delivered by the parting roller 6, and the lower one can be returned rapidly by the retard roller 7 to the hopper 3*b* side. This prevents jamming of the overlapping sheets of paper between the pickup roller 5 and the retard roller 7, making it possible to provide effective image reading without any troubles involved in the paper feeding.

In a third embodiment, the image scanner shown in FIG. 1 comprises, as exterior members, a housing 1 which rises from an operation part 1*a* on the right side when viewed from the front and a sub housing 2 continuous with the operation part 1*a* and positioned on the left side thereof in such a manner as to be able to open up, with a paper feed unit 3 for carrying documents such as sheets of paper being attached on the front side of the housing 1 at the underside of the sub housing 2. The housing 1 and the sub housing 2 are provided with an image reader in the form of the combination of the paper transport mechanism and an optical system. The sheets of paper fed from the paper feed unit 3 are subjected to image reading and thereafter are discharged to the collection tray 2*a* formed on top surface of the sub housing 2.

The paper feed unit 3 comprises a frame 3*a* fixed to the housing 1 and a hopper 3*b* housed in the frame 3*a* for carrying sheets of paper, the hopper 3*b* including a pair of guides (described later) which can vary a distance between them in correspondence with the size of the sheets of paper. Then, the hopper 3*b* is pivotally attached at its both end on the tip side thereof to the frame 3*a*, with the free end on the base side thereof being rotatable in vertical direction. That is, the frame 3*a* is kept at its posture fixed to the housing 1 shown in FIG. 1, and within the frame 3*a* the hopper 3*b* is assembled to the housing 1 in such a manner that its base end is freely movable vertically.

Figure 10:
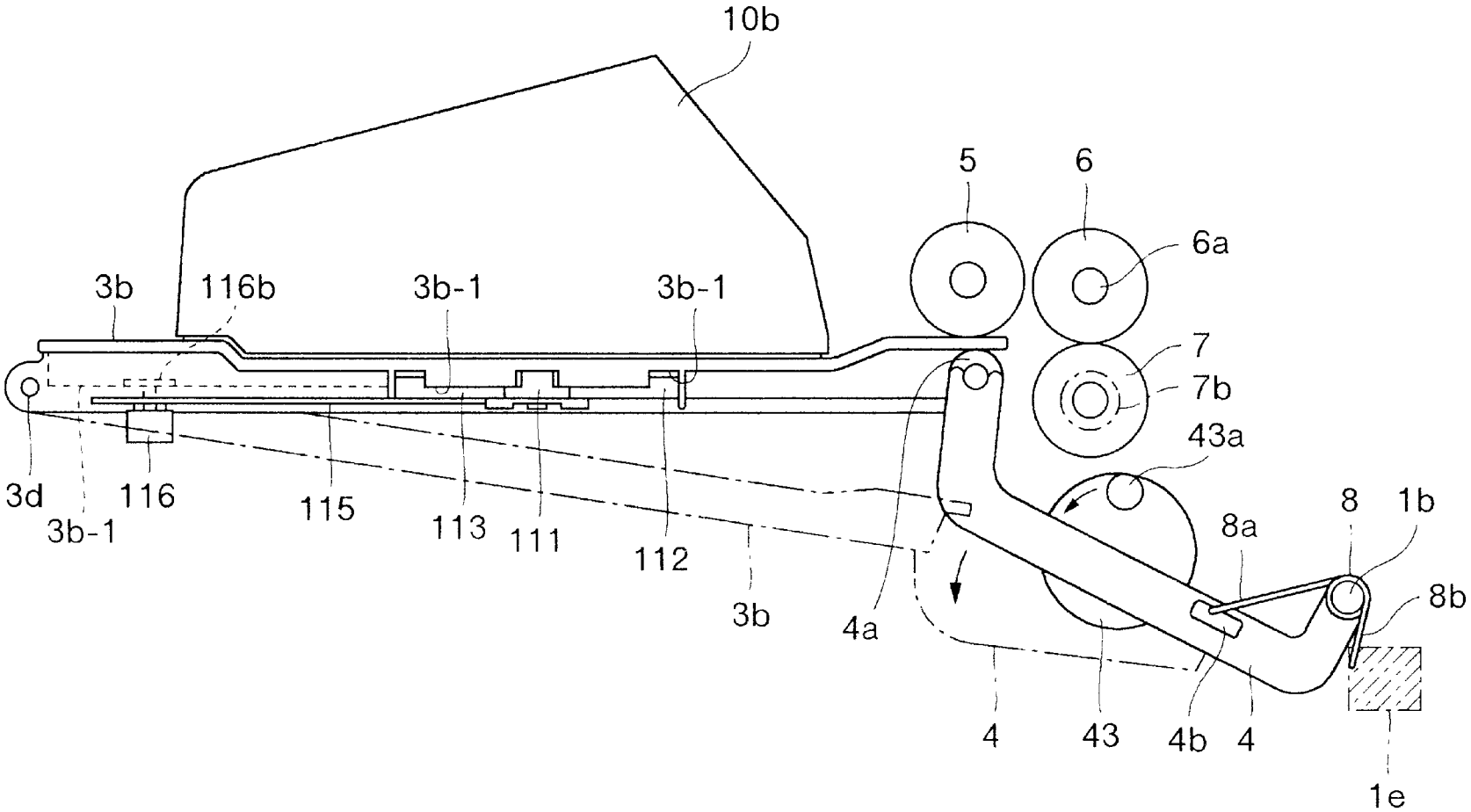
FIG. 10 is a vertical sectional view showing the main part of the paper feeding apparatus of the third embodiment.
Figure 11:
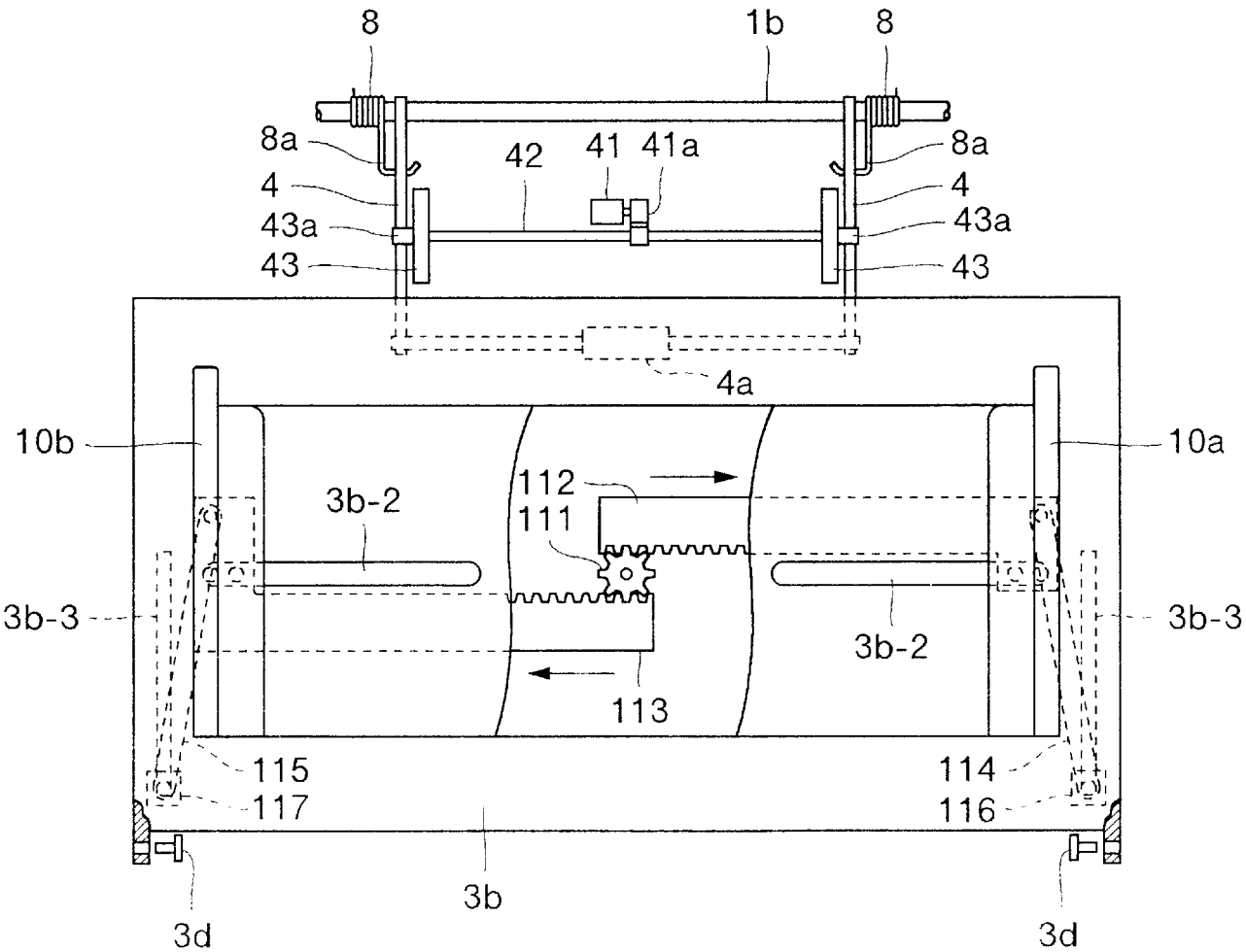
FIG. 11 is a top view showing the main part of the paper feeding apparatus of the third embodiment.

In FIGS. 10 and 11, two arms 4 are rotatably attached around the support shaft 1*b* fixed to the interior of the housing 1, and the tip ends of the arms 4 are mounted rotatably with a support roller 4*a* for carrying the bottom surface of the hopper 3*b* on the base end thereof. On the other hand, the hopper 3*b* is rotatably connected at its tip to the frame 3*a* by way of a pin 3*d*. Accordingly, when the arm 4 is it rotated from the position indicated by a chain dotted line to the posture shown in a solid line in FIG. 10, the support roller 4*a* carrying the hopper 3*b* at its base end lifts the hopper with the rotation thereof. Further, when the arm 4 is turned in the counterclockwise direction in FIG. 10, the hopper 3*b* lowers at its base end and is set to the posture indicated by the chain dotted line in the Figure.

The sub housing 2 accommodates a pickup roller 5 located at the position covering the upper surface of the hopper 3*b* on its base end side and a parting roller 6 located at the position somewhat away from the hopper 3*b*. The pickup roller 5 and the parting roller 6 are individually disposed at the central portion in the width direction of the hopper 3*b*, and the drive shaft 6*a* extending through the parting roller 6 is joined to the output shaft of the drive motor, not shown. Then, between the parting roller 6 and the pickup roller 5 there is interposed a drive system in the form of a gear train such that the parting roller 6 and the pickup roller 5 can be rotated at the same peripheral speed.

Further, below the parting roller 6 there is disposed retard rollers 7 for the prevention of overlap feeding at both sides of the pass line for the sheets of paper fed from the hopper 3*b*. The retard roller 7 is provided with a torque limiter 7*b*, and as well known in the prior art, continues to rotate in the direction putting back the sheets of paper toward the hopper 3*b* when the torque on the retard roller is not more than the critical setting torque of the torque limiter, in other words, when there is any overlap feeding, but on the contrary it reversely rotates in the paper feed direction when a load equal to or more than the critical setting torque is applied without any overlap feeding of sheets of paper.

A torsion spring 8 intervenes between the periphery of the support shaft 1*b* and the arm 4 supporting the base end side of the hopper 3*b*, the torsion spring 8 acting to press the sheets of paper loaded in the hopper 3*b* against the pickup roller 5. The torsion spring 8, as shown in FIG. 10, comprises two hooks 8*a* and 8*b* which are both ends of the torsion spring in the winding direction protruding in the tangential direction from the peripheral surface of the windings. The hook 8*a* on the one end side is inserted into the engagement hole 4*b* provided in the arm 4, and the hook 8*b* abuts against a restraint block 1e fixedly disposed in the vicinity of the support shaft 1*b*.

On the other hand, a drive motor 41 is disposed as shown in FIG. 11 so as to provide a drive mechanism for pressing down the arm 4 against the upward biasing force of the arm 4 exerted by the torsion spring 8. The output shaft of the drive motor 41 is connected via a gear train 41*a* to a transmission shaft 42 having an axis parallel to the support shaft 1*b*, and the both ends of the transmission shaft 42 in the axial direction is amounted with two flanges of a disk shape.

The two flanges 43 confront each arm 4 as shown in FIG. 11 and each have a boss 43*a* abutting against the upper surface of the arm 4 according to the rotational posture of the flange 43, the boss 43*a* projecting from the proximity on the outer periphery of the flange 43.

In the state of FIG. 10, the boss 43*a* is apart from the upper surface of the arm 4. Thus, there is no restraint of the arm 4 in the downward direction, and the arm 4 turns in the clockwise direction around the support shaft 1*b* by the biasing force of the torsion spring 8, allowing the upper surface of the base end of the hopper 3*b* to come nearest to the pickup roller 5. Therefore, the topmost one of the sheets of paper carried on the hopper 3*b* is pressed against the peripheral surface of the pickup roller 5 and the pressing force at that time is determined by the strength of the biasing force of the torsion spring 8. On the contrary, when the flange 43 is turned by the drive motor 41, the boss 43*a* comes to abut against the upper surface of the arm 4 whereby the arm 4 is pushed downward by the boss 43*a*. Then, when the boss 43*a* is located at its lowest position, the arm 4 assumes its posture indicated by the chain dotted line in FIG. 10, with the hopper 3*b* being turned in the counter-clockwise direction around the pin 3*d* and being inclined in the right side and downward direction.

Figure 12:
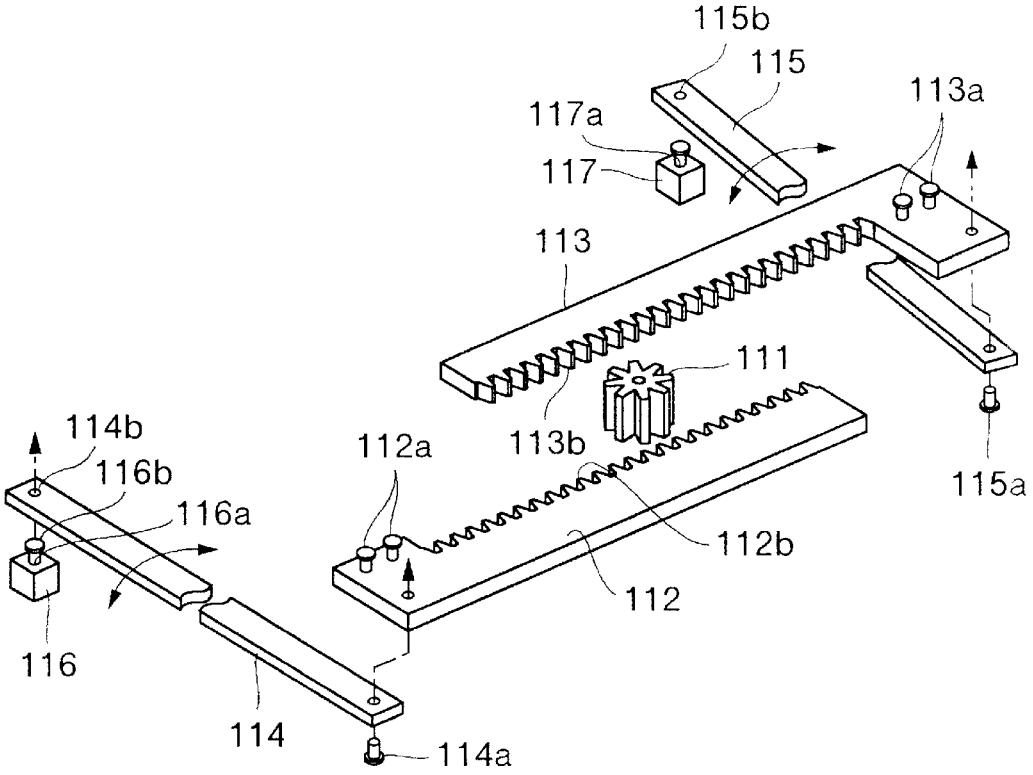
FIG. 12 is an explodedperspective view of the pin, rack, link rod and balance weight in the third embodiment.

On the upper surface of the hopper 3*b*, there are provided guides 10*a* and 10*b* which can move together in the width direction (right to left direction in FIG. 11) of the hopper 3*b* depending on the size of the sheets of paper loaded. Then, in order to allow the guides 10*a* and 10*b* to move in conjunction, the underside of the hopper 3*b* is provided with a pinion 111 and racks 112 and 113 coupled integrally with the guides 10*a* and 10*b*. FIG. 12 is an exploded perspective view of the pinion 111, the racks 112 and 113 and a mechanism for adjusting the biasing force of the torsion spring 8.

The pinion 111 is supported rotatably on the bottom surface at the substantially middle of the hopper 3*b* in the width direction, and the racks 112 and 113 meshing with the pinion 111 are arranged into sliding grooves 3*b*-1 (see FIG. 10) provided in the bottom surface of the hopper 3*b*. The racks 112 and 113 are arranged such that their respective toothings 112*b* and 113*b* confront each other, the racks being provided at their respective one end sides with threads 112*a* and 113*a* extending from a guide slit 3*b*-2 opening into the hopper 3*b* for coupling the guides 10*a* and 10*b* together. Thus, when the guide 10*a* on one hand is shifted sideward, the pinion 111 rotates and thereby the guide 10*b* on the other moves in conjunction therewith. Then, the direction of the motion of the guides 10*a* and 10*b* is the direction either apart from or coming closer to each other.

Further, balance weights 116 and 117 are connected via link rods 114 and 115 to the one ends of the racks 112 and 113. The link rods 114 and 115 are disposed along the bottom surfaces of the racks 112 and 113 and at their base end side are pivoted to the racks 112 and 113 by means of pins 114*a* and 115*a* so as to perform pivotal action in the direction indicated by the arrow in FIG. 12. The balance weights 116 and 117 are in the form of weights and have pin portions 116*a* and 117*a* provided on their upper surfaces for being rotatably inserted for attachment into retaining holes 114*b* and 115*b* formed in the tip of the link rods 114 and 115.

Figure 13:
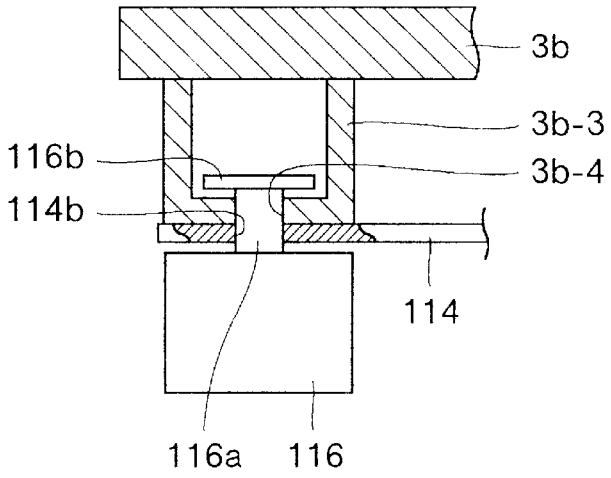
FIG. 13 is a vertical sectional view of the main part showing the junction structure of the balance weight to the guide rail provided on the bottom of the hopper in the third embodiment.

On the other hand, the lower surface of the hopper 3*b* is provided with a guide rail 3*b*-3 for restricting the balance weights 116 and 117 for guidance. The guide rail 3*b*-3 is disposed between the tip end side (pin 3*d* side) of the hopper 3*b* and substantially the middle position toward the base end side. FIG. 13 is a sectional view of the conjunction structure between the balance weight 116 on the link rod 114 side and the guide rail 3*b*-3. The guide rail 3*b*-3 is formed at its bottom surface with a slit 3*b*-4 for receiving a pin portion 116*a* of the balance weight 116. The slit receives a flange portion 116*b* at the upper end of the pin portion in a freely sliding manner. The same applies to the relation between the other balance weight 117 and the guide rail 3*b*-3.

It is to be appreciated that when the maximum size of the actually handling sheets of paper is one allowing the positional relationship in which the guides 10*a* and 10*b* are apart from each other by farthest distance as shown in FIG. 11, the spring constant of the torsion spring 8 is determined based on the load which occurs when a maximum number of the sheets of paper are mounted on the hopper 3*b*. This is due to the fact that it is necessary to obtain for a desired pressing force under the maximum load in use since the pressing force of the sheets of paper against the pickup roller is based on the biasing force of the torsion spring 8. Then, after the delivery of the sheets of paper after the loading of the maximum number of the sheets of paper, the weight load gradually reduces and the restoring force of the torsion spring 8 tends to increase. However, due to a certain range in the appropriate pressing force on the pickup roller 5, an excess pressing force would not be generated to such a degree causing an occurrence of jamming between the retard roller 7 and the pickup roller 5.

In the above construction, when the pickup roller 5 and the parting roller 6 are driven in rotation, the topmost sheet of paper mounted on the hopper 3*b* is delivered by the frictional force relative to the pickup roller 5 in the same manner as in the prior art. Then, the parting roller 6 and the retard roller 7 cooperate in pair to perform the transport of the sheets of paper or the putting back the one in the overlap feeding by function of the torque limiter as set forth hereinabove.

Herein, the carrying load of the hopper 3*b* of the paper feed unit 3 may vary depend on the size of the sheets of paper as described above. That is, if a pressing force of the sheets of paper against the pickup roller 5 is too large, the paper is not only apt to be delivered in the overlapping manner but also the overlapping sheet returning function of the retard roller 7 may be impaired.

As opposed to this, the present invention enables the positions of the balance weights 116 and 117 disposed on the lower surface of the hopper 3*b* to vary in conjunction with the motion of the guides 10*a* and 10*b* guiding the width direction of the sheets of paper, whereby the pressing force on the pickup roller 5 can be kept at an appropriate range regardless of the sheets of paper having a small size.

First of all, when the size of the sheets of paper is large, the guides 10*a* and 10*b* are moved to positions where they are most apart from each other as shown in FIG. 11, with the result that the racks 112 and 113 integral with the guides 10*a* and 10*b* are also moved in the same direction. Accordingly, the balance weights 116 and 117 move to the positions closest to the pin 3*d*, the balance weights being joined continuously via the link rods 114 and 115 with the racks 112 and 113, and the direction of movement of the balance weights being restricted by the guide rail 3*b*-3. In this manner, when the size of the sheets of paper is large, the balance weights 116 and 117 come closer to the pin 3*d* to reduce the moment around the pin 3*d*.

That is, when the size of sheets of paper is large, the mounting load on the hopper 3*b* becomes also increased and the force pressing down the hopper 3*b* around the pin 3*d* is strong. On the other hand, the balance weights 116 and 117 are automatically set to positions where the moment around the pin 3*d* becomes small in conjunction with the motions of the guides 10*a* and 10*b*, and hence the load by the balance weights 116 and 117 on the arm 4 can be suppressed.

Figure 14:
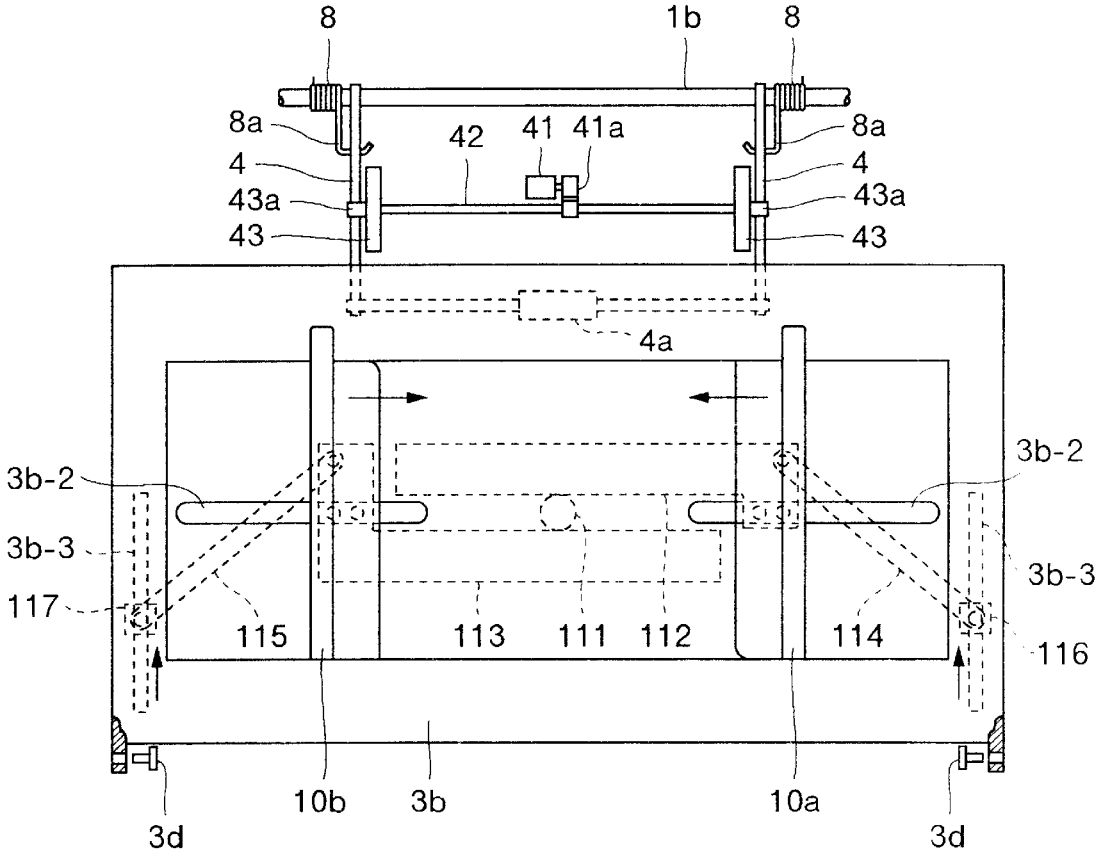
FIG. 14 is a top view of the main part showing the movement of the balance weight in case that the guide interval is narrowed in the third embodiment.

On the other hand, when the size of the sheets of paper is small, the guides 10*a* and 10*b* move closer to each other as shown in FIG. 14. Then, in conjunction with the motion of the guides 10*a* and 10*b*, the link rods 114 and 115 come to change their postures and simultaneously the balance weights 116 and 117 move in the direction away from the pin 3*d* along the guide rail 3*b*-3. Thus, the moment by the balance weights 116 and 117 around the pin 3*d* becomes larger so that when the paper size is small the balance weights 116 and 117 compensate for the loads on the torsion spring 8. For this reason, the biasing force of the torsion spring 8 is suppressed, preventing the pressing force on the sheets of paper against the pickup roller 5 from becoming excess.

In this manner, the position of the balance weights 116 and 117 is automatically set in conjunction with the guides 10*a* and 10*b* moving depending on the size of the sheets of paper mounted on the hopper 3*b*, whereby the biasing force of the torsion spring 8 is adjusted in accordance with the paper size. Thus, the contact pressure between the pickup roller 5 and the sheets of paper can be set to the appropriate value, thereby providing an effective prevention of the overlapping delivery by the pickup roller 5. Then, by optimizing the biasing force of the torsion spring 8, the pressing reaction force from the pickup roller 5 can be suppressed to such a degree not as to interfere with the paper returning force exerted by the retard roller 7. Accordingly, even though any overlapping fed has occurred under the influence of types of paper, humidity and the like, the upper paper upon the overlap feeding is only delivered by the parting roller 6, and the lower paper can be returned rapidly by the retard roller 7 to the hopper 3*b* side. This prevents jamming of the overlapping sheets of paper between the pickup roller 5 and the retard roller 7, making impossible to provide effective image reading without any troubles involved in the paper feeding.

In a fourth embodiment, the image scanner shown in FIG. 1 comprises, as exterior members, a housing 1 which rises from an operation part 1*a* on the right side when viewed from the front and a sub housing 2 continuous with the operation part 1*a* and positioned on the left side thereof in such a manner as to be able to open up, with a paper feed unit 3 for carrying documents such as sheets of paper being attached on the front side of the housing 1 at the underside of the sub housing 2. The housing 1 and the sub housing 2 are provided with an image reader in the form of the combination of the paper transport mechanism and an optical system. The sheets of paper fed from the paper feed unit 3 are subjected to image reading and thereafter are discharged to the collection tray 2*a* formed on top surface of the sub housing 2.

The paper feed unit 3 comprises a frame 3*a* fixed to the housing 1 and a hopper 3*b* housed in the frame 3*a* for carrying sheets of paper, the hopper 3*b* including a pair of side guides 10*a* and 10*b* which can vary a distance between them in correspondence with the size of the sheets of paper. Then, the hopper 3*b* is pivotally attached via a pin 3*d* at its both end on the tip side thereof to the frame 3*a*, with the free end on the base side thereof being rotatable in vertical direction. That is, the frame 3*a* is kept at its posture fixed to the housing 1 shown in FIG. 1, and within the frame 3*a* the hopper 3*b* is assembled to the housing in such a manner that its base end is freely movable vertically.

Figure 15:
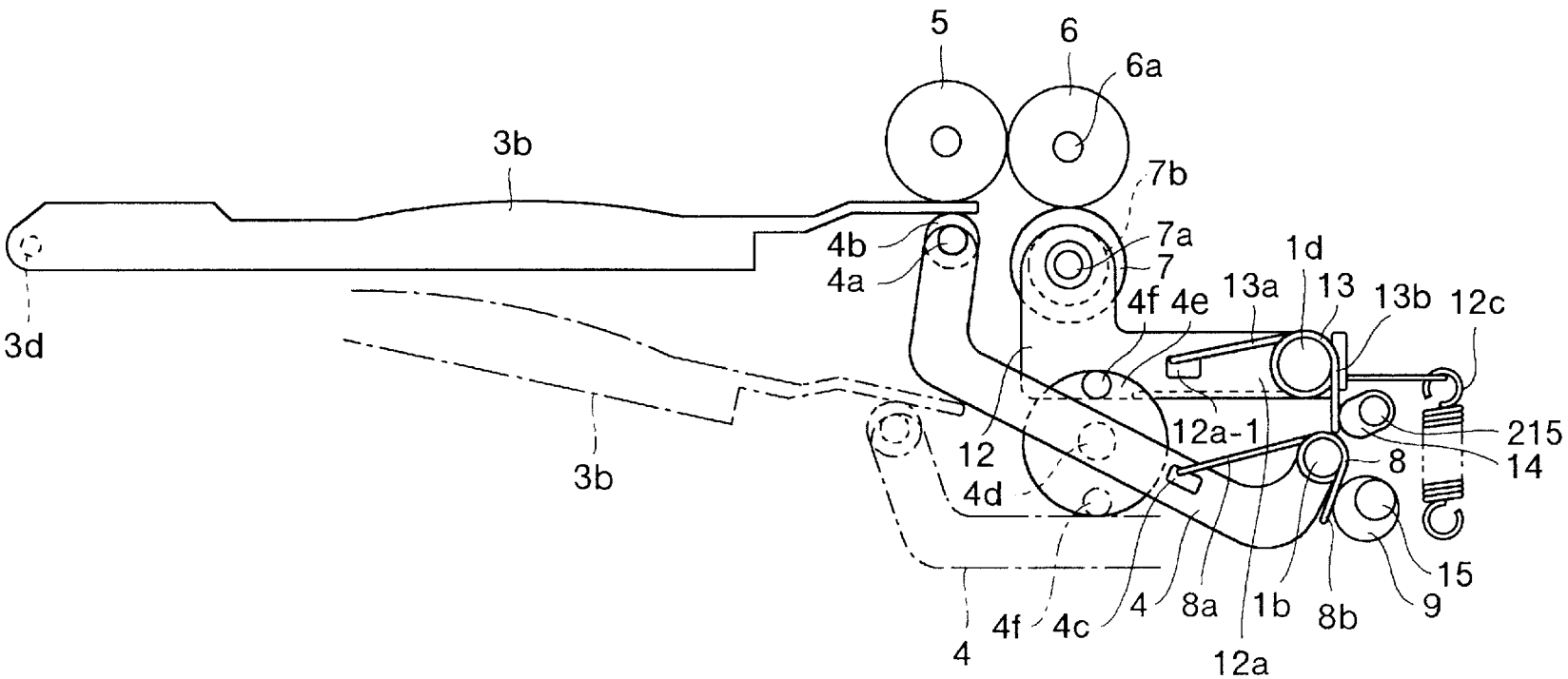
FIG. 15 is a vertical sectional view showing the main part of the paper feeding apparatus of the fourth embodiment.
Figure 16:
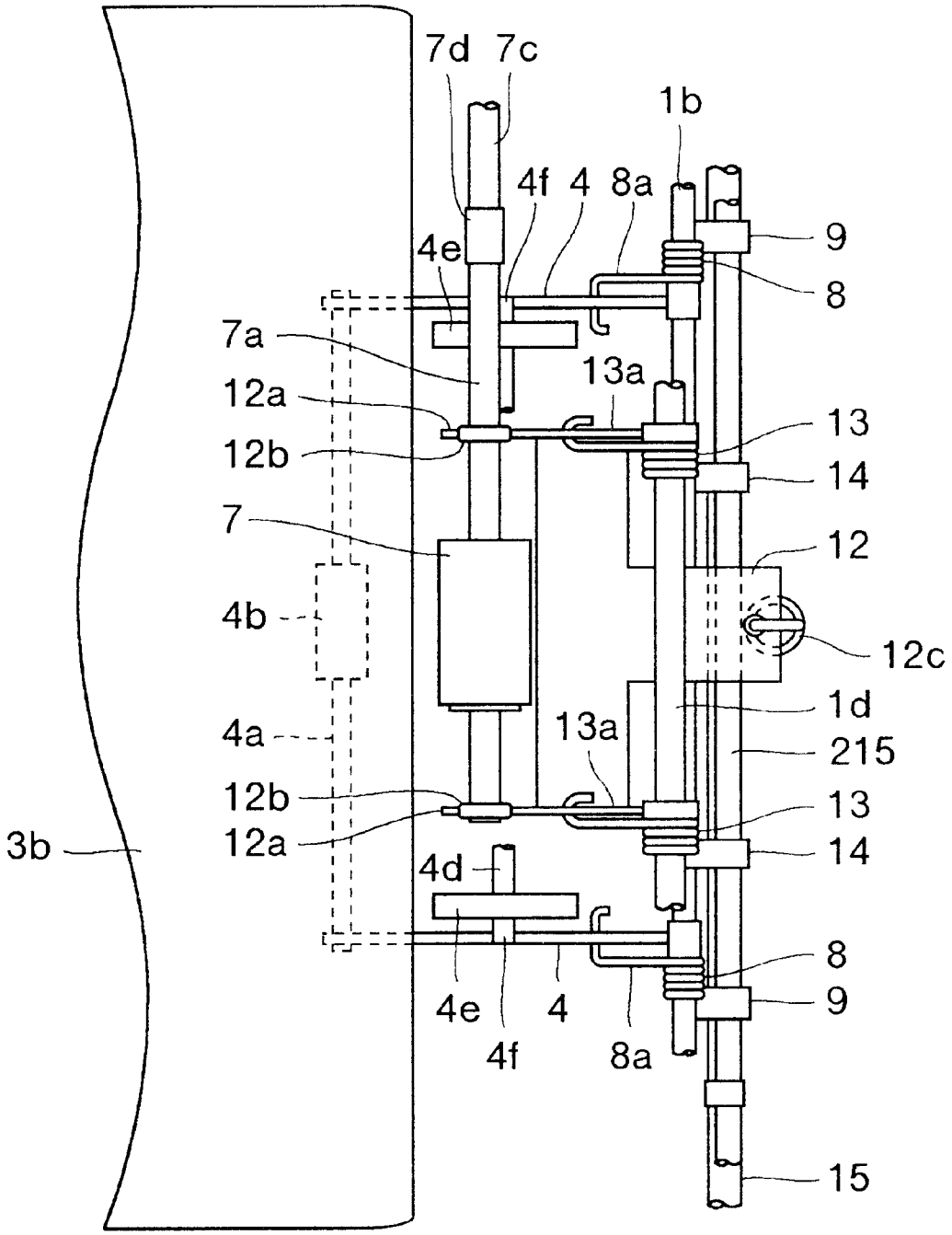
FIG. 16 is a top view showing the main part of the paper feeding apparatus of the fourth embodiment.

In FIGS. 15 and 16, two arms 4 are rotatably attached around the first support shaft 1*b* fixed to the interior of the housing 1, and a retaining shaft 4*c* coupling the tip ends of the arms together is mounted rotatably with a support roller 4*a* for carrying the bottom surface of the hopper 3*b* on the base end thereof. On the other hand, the hopper 3*b* is connected at its tip end via a pin 3*d* to the frame 3*a* in such a manner that its base end is freely rotatable in the vertical direction. Accordingly, when the arm 4 is rotated from the position indicated by a chain dotted line to the posture shown in a solid line in FIG. 15, the support roller 4*a* carrying the hopper 3*b* at its base end lifts the hopper with the rotation thereof. Further, when the arm 4 is turned in the counterclockwise direction, the hopper 3*b* lowers at its base end and is set to the posture indicated by the chain dotted line in the Figure.

The sub housing 2 accommodates a pickup roller 5 located at the position covering the upper surface of the hopper 3*b* on its base end side and a parting roller 6 located at the position somewhat away from the hopper 3*b*. The pickup roller 5 and the parting roller 6 are individually disposed at the central portion in the width direction of the hopper 3*b*, and the drive shaft 6*a* extending through the parting roller 6 is joined to the output shaft of the drive motor, not shown. Then, between the parting roller 6 and the pickup roller 5 there is interposed a drive system in the form of a gear train such that the parting roller 6 and the pickup roller 5 can be rotated at the same peripheral speed.

Further, below the parting roller 6 there is disposed retard rollers 7 for the prevention of overlap feeding at both sides of the pass line for the sheets of paper fed from the hopper 3*b*. The retard roller 7 is provided with a torque limiter, and as well known in the prior art, continues to rotate in the direction putting back the sheets of paper toward the hopper 3*b* when the torque on the retard roller is not more than the critical setting torque of the torque limiter, in other words, when there is any overlap feeding, but on the contrary it reversely rotates in the paper feed direction when a load equal to or more than the critical setting torque is applied without any overlap feeding of sheets of paper.

In order to ensure that the topmost one of the sheets of paper mounted on the hopper 3*b* comes into contact with the pickup roller 5 and is delivered by its frictional force, a torsion spring 8 intervenes between the periphery of the first support shaft 1*b* and the arm 4. The torsion spring 8 can be a torsion coil spring.

As shown in FIG. 6, the torsion spring 8 comprises two hooks 8*a* and 8*b* which are both ends of the torsion spring in the winding direction protruding in the tangential direction from the peripheral surface of the windings. The hook 8*a* on the one end side is inserted into the engagement hole 4*b* provided in the arm 4, and the hook 8*b* on the other end side is a free end. A hopper cam 9 is disposed to come into contact with the hook 8*b* which is the free end, the hopper cam 9 adjusting the resilient biasing force of the torsion spring 8.

The hopper cam 9 is fixed to the adjusting shaft 15 provided in the housing 1 in its width direction, and a adjusting dial 15*a* is mounted on one end of the adjusting shaft 15 and is on the side surface of the housing 1 as shown in FIG. 1. The outline of the hopper cam 9, as shown in FIG. 15, is a circular form offset relative to the adjusting shaft 15 and pushes the hook 8*b* toward the direction tightening the torsion spring 8 in its winding direction. Then, by turning the adjusting dial 15*a*, it is possible to change the position of the peripheral surface of the hopper cam 9 abutting against the hook 8*b* and thereby to adjust the tightening degree of the torsion spring 8 in the winding direction.

On the other hand, an operation shaft 4*d* is disposed within the housing 1 so as to provide a drive mechanism for pressing down the arm 4 against the upward pivoting biasing force of the arm 4 exerted by the torsion spring 8. The operation shaft 4*d* has an axis parallel with the first support shaft 1*b* and can be rotationally driven by a drive motor, not shown, disposed within the housing 1. Then, as shown in FIG. 16, the both ends of the operation shaft 4*d* in the axial direction are provided with a pair of disk-like flanges 4*e* confronting each other, the flanges 4*e* being provided with bosses 4*f* abutting against the upper surface of the arm 4 according to their rotational postures.

By virtue of the provision of such operation shaft 4*d*, the bosses 4*f* indicated by solid lines in FIG. 15 are apart from the upper surface of the arm 4 with no downward restriction of the arm 4, so that the arm 4 rotates in the clockwise direction around the first support shaft 1*b* by the biasing force of the torsion spring 8, allowing the upper surface of the base end of the hopper 3*b* to come closest to the pickup roller 5. On the other hand, when the operation shaft 4*d* is rotated by the drive motor, the bosses 4*f* come to abut against the upper surface of the arm 4, and the arm 4 is pressed downward by the bosses 4*f*. Then, when the bosses 4*f* moves to its lowest position in rotation, the arm 4 becomes substantially horizontal, so that the hopper 3*b* is allowed to assume the inclined posture as indicated by the chain dotted line in FIG. 15.

The retard roller 7 is supported by a base 12 disposed within the housing 1 and connected rotatably around the second support shaft 1*d* parallel with the first support shaft 1*b*, and comprises a spindle 7*a* supported by the bearing 12*b* disposed in the rim 12*a* of the base 12 and a torque limiter 7*b* connected with the spindle 7*a*. Then, via a flexible joint 7*d* to the spindle 7*a*, there is connected a transmission shaft 7*c* for coupling a motor, not shown, for rotationally driving the retard roller 7. The flexible joint 7*d* is in the form of a tube making use of a synthetic resin for example and serves to follow any possible variation in vertical position relative to the fixed transmission shaft 7*c*, thereby to transmit the rotation.

A tension coil spring 12*c* is interposed between the one end side of the base 12 and the bottom side of the housing 1 and biases the base 12 in the clockwise direction around the second support shaft 1*d* in FIG. 15. Thus, the retard roller 7 is kept in the state where it is pressed by a certain pressing force corresponding to the tensile force of the coil spring 12*c* against the parting roller 6.

The function of the torque limiter 7*b* disposed between the retard roller 7 and the spindle 7*a* is the same as that described in the prior art example, thus the spindle 7*a* is usually rotated in the counterclockwise direction in FIG. 15. Then, when the torque on the retard roller is not more than the critical setting torque of the torque limiter 7*b*, that is, when there is any overlap feeding of the sheets of paper, the retard roller 7 rotates together with the spindle 7*a* to put back the sheets of paper toward the hopper 3*b*, whereas when any load equal to or more than the critical setting torque is applied without any overlap feeding of sheets of paper, it reversely rotates in the clockwise direction in FIG. 15.

Two torsion springs 13 in the form of torsion coil springs are inserted around the second support shaft 1*d* and are connected to the base 12 retaining the retard roller 7, the torsion springs 13 serving to bias the base 12 in the clockwise direction in FIG. 15. The torsion springs 13 comprises two hooks 13*a* and 13*b* in the same manner as the torsion spring 8 provided around the first support shaft 1*b*, while the hook 13*a* on one end side is inserted into an engagement hole 12-1 formed in a rim 12*a* of the base as shown in FIG. 15, and the hook 13*b* on the other end side is free end. Then, the hook 13*b* in the form of the free end is in contact with the parting cam 14 for adjusting the biasing force of the torsion springs 13.

Figure 17:
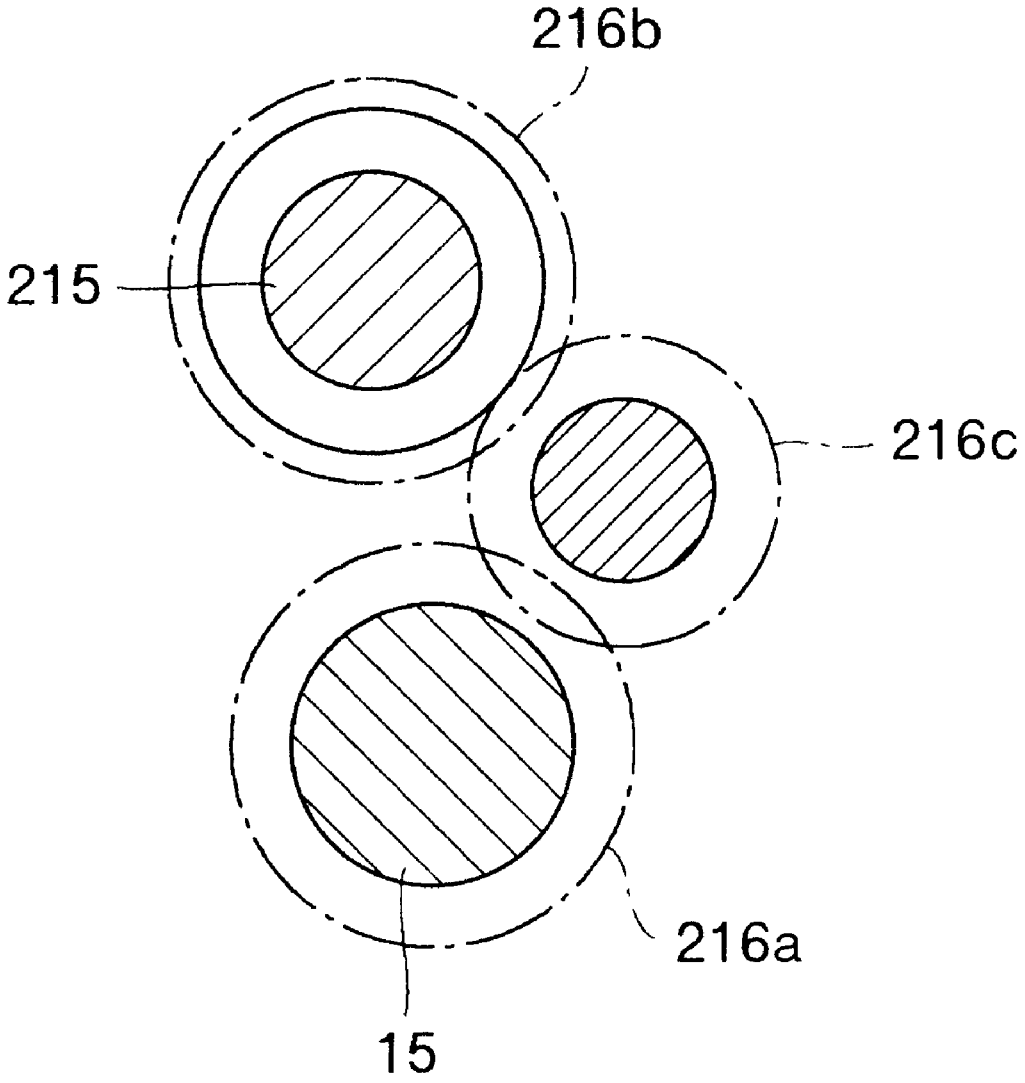
FIG. 17 is a schematic view showing the junction of the adjusting shaft and the rotational support shaft via the gears between them in the fourth embodiment.

The parting cam 14 is fixed to a rotational support shaft 215 parallel with an adjusting shaft 15 and rotatable around the axis, and its exterior contour is of a substantially elliptical form offset relative to the rotational support shaft 215, and press the hook 13*b* in the direction tightening the torsion spring 13 in its winding direction. Then, the adjusting shaft 15 and the rotational support shaft 215 are mounted with flat gears 216*a* and 216*b* as shown in FIG. 17, between them, there intervenes an intermediate gear 216*c*, allowing the rotational support shaft 215 to rotate in the same direction simultaneously with the rotation of the adjusting shaft 15 when the adjusting dial 15*a* is rotationally operated. Thus, when the adjusting dial 15*a* is operated, the posture of the parting cam 14 abutting against the hook 13*b* varies so that the tightening degree of the torsion spring 13 in its winding direction is adjusted.

Figure 18A:
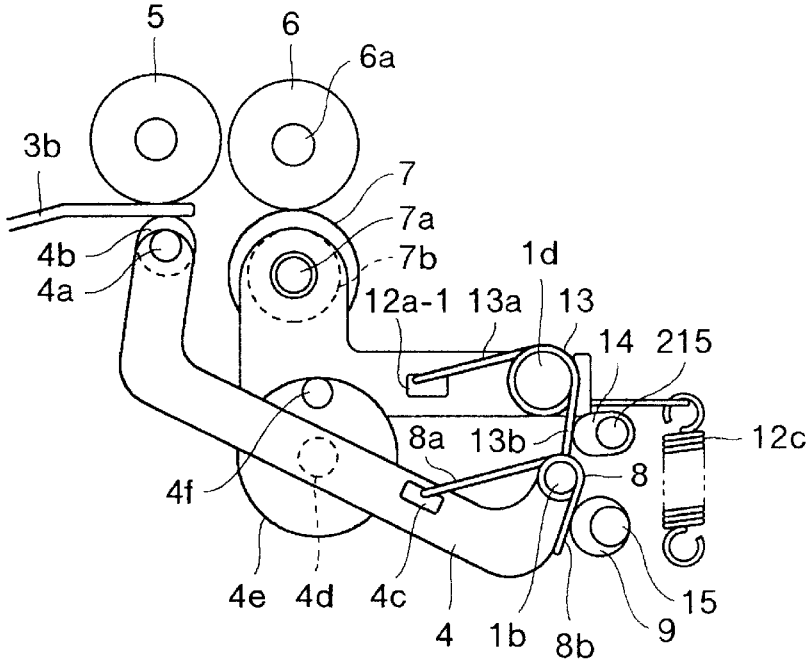
FIGS. 18A and 18B are views showing the setting of the pressing force of the torsion spring by the hopper cam in the fourth embodiment.
Figure 18B:
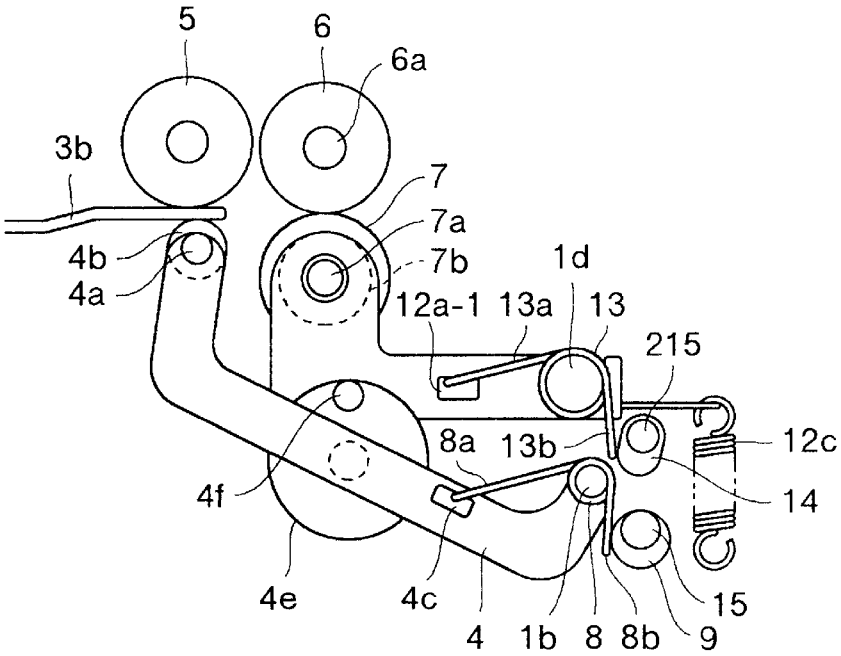

FIGS. 18A and 18B are schematic Figures for explaining the adjustment of the biasing force of the torsion springs 8 and 13, by the postures of the hopper cam 9 and the parting cam 14.

FIG. 18A shows the state in which maximum setting values are imparted to the pressing force of the hopper 3*b* against the pickup roller 5 and to the pressing force of the retard roller 7 against the parting roller 6. The outer peripheral surfaces of the hopper cam 9 and the parting cam 14 farthest apart from the rotational centers of the adjusting shaft 15 and the rotational support shaft 215 abut against the hooks 8*b* and 13*b* of the torsion springs 8 and 13. At that time, there appears the maximum tightening degree of the torsion springs 8 and 13 in the winding direction around the adjusting shaft 15 and the rotational support shaft 215 so that the arm 4 and the base 12 are strongly biased in the clockwise direction around the first and second support shafts 1*b* and 1*d*.

FIG. 18B shows the state in which the pressing forces of the hopper 3*b* and of the retard roller 7 are set to minimum values by rotating the adjusting shaft 15 in the counterclockwise direction in the Figure from the maximum setting state of FIG. 18A. In this state, the peripheral surfaces of the hopper cam 9 and the parting cam 14 having small offset amounts abut against the hooks 8*b* and 13*b* so that the tightening degree of the torsion springs 8 and 13 in the winding direction becomes smaller, with the result that the pressing force of the hopper 3*b* against the pickup roller 5 and the pressing force of the retard roller 7 against the parting roller are both loosened.

In this manner, when the adjusting dial 15*a* is rotationally operated, the rotational support shaft 215 rotates in the same direction in conjunction with the adjusting shaft 15, so that pressing forces set on the hopper 3*b* and the retard roller 7 by the torsion springs 8 and 13 can simultaneously be varied. Then, the adjustment of this pressing force allows loosening or strengthening of the pressing force on the hopper 3*b* side and the retard roller 7 side, thereby providing a stepless adjustment of the biasing force of the torsion springs 8 and 13.

In the above construction, when the pickup roller 5 and the parting roller 6 are rotationally driven, the topmost one of the sheets of paper mounted on the hopper 3*b* is delivered by the frictional force with the pickup roller 5 in the same manner as in the prior art example. Then, the parting roller 6 and the retard roller 7 cooperates in pair, and the conveyance of the sheets of paper and the putting back of the overlapping sheets of paper are carried out by the function of the torque limiter 7*b* as set forth hereinabove.

In this case, the description has already been made that when the sheets of paper are fed from the hopper 3*b*, if the pressing force of the sheets of paper against the pickup roller 5 is too strong, the paper is not only apt to be delivered in the overlapped manner, but also the overlap feeding prevention function by the retard roller 7 may be impaired. Further, due to different coefficient of frictions for each quality of paper, the nip force, that is, the pressing force between the parting roller 6 and the retard roller 7 must be set so as to ensure that the critical setting torque of the torque limiter acts in an appropriate manner.

As opposed to this, the present invention enables the postures of the hopper cam 9 and the parting cam 14 to simultaneously be varied by operating the adjusting dial 15*a* as set forth in FIGS. 18A and 18B, to thereby make it possible to adjust the pressing force between the hopper 3*b* and the pickup roller 5 and between the parting roller 6 and the retard roller 7. Then, in order to optimize the paper separation function by the parting roller 6 and the retard roller 7 from the paper feeding by the pickup roller 5 in this adjustment, the following conditions must be satisfied.

Figure 19A:
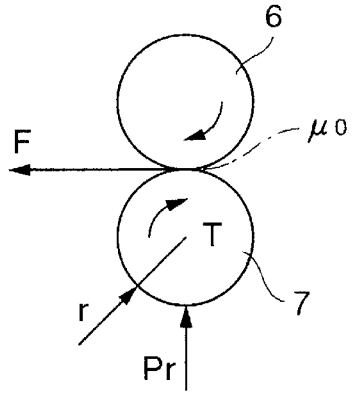
FIGS. 19A, 19B and 19C are explanatory views for finding optimum conditions for the pressing force of the hopper against the pickup roller and for the pressing force of the retard roller against the parting roller in the fourth embodiment.

In this case, the conditions for ensuring correct operation of the paper P separation function by the parting roller 6 and the retard roller 7 are as follows, and are described with reference to FIGS. 19A, 19B and 19C. In the following conditional expressions, Pr is a pressing force of the retard roller 7, T is a critical setting torque of the torque limiter 7*b*, r is a radius of the retard roller 7, $\mu_0$ is a coefficient of friction between the parting roller 6 and the retard roller 7, and m is a mass of a sheet of paper P. At that time, T, r, $\mu_0$ and m are constants.

(1) When no sheets of paper P lie between the parting roller 6 and the retard roller 7:

The retard roller 7 comes into contact with the parting roller 6 and entrains it. That is, the retard roller 7 rotates in the counterclockwise direction opposite to the direction indicated by the solid line in FIG. 19A. The condition therefor is $F=\mu_0 \cdot Pr>T/r$ where the conveyance force caused by the friction between the parting roller 6 and the retard roller 7 is F. Thus, the following expression results.

$$Pr>(1/\mu_0)\times(T/r) \quad (a)$$

(2) When only one sheet of paper P lies between the parting roller 6 and the retard roller 7:

No slippage occurs between the parting roller 6 and the sheet of paper P, to impart a feeding to the sheet of paper P, while simultaneously there is no slippage between the retard roller 7 and the sheet of paper P so that the retard roller entrains the parting roller 6 for the feed of the sheet of paper P. The condition therefor is $\mu_2 \cdot Pr>T/r$. Thus, the following expression (b) results.

$$Pr>(1/\mu_2)\times(T/r) \quad (b)$$

Figure 19B:
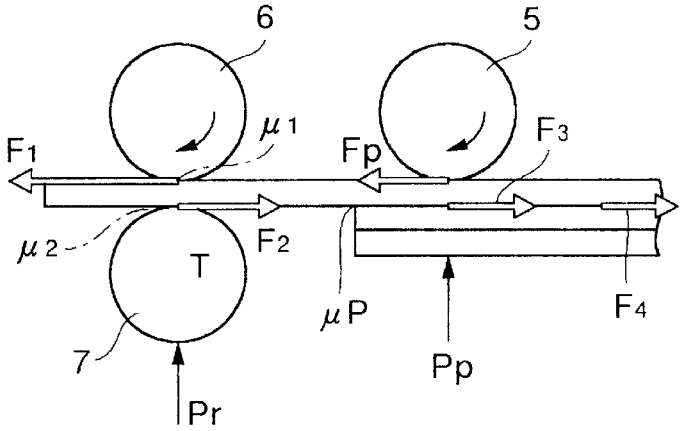
Figure 19C:
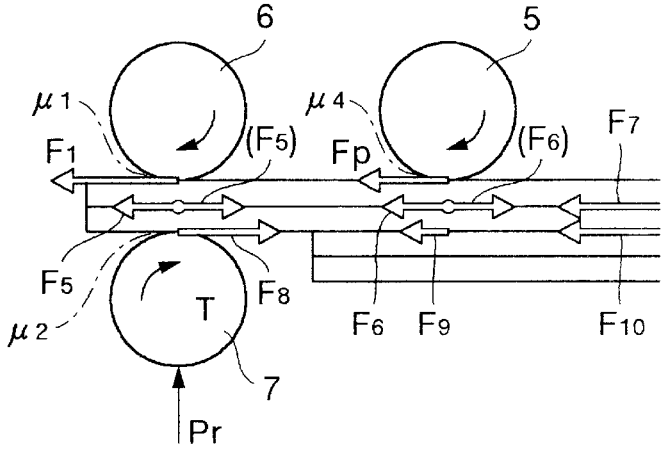
Figure 20:
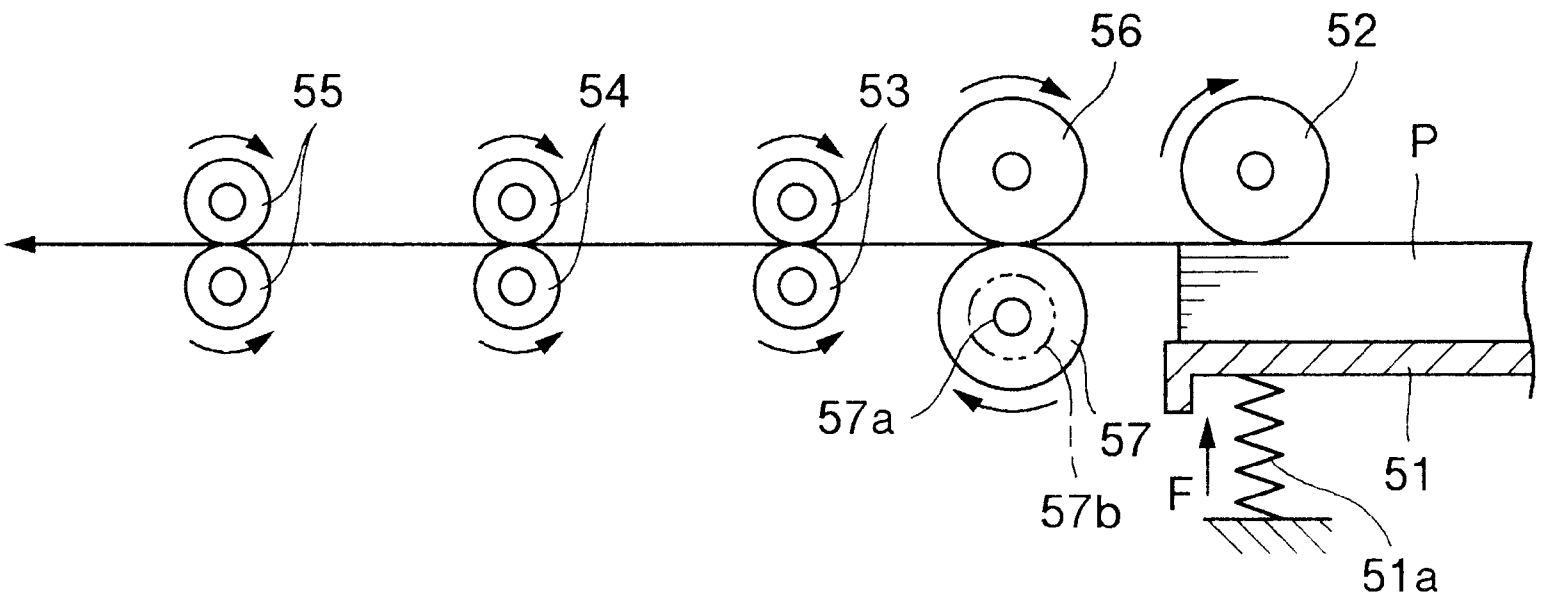
FIG. 20 is a schematic view showing a typical example of the conventional overlap feeding prevention mechanism.

Then, as the conditions of the conveyance force of the parting roller 6 for conveying the sheets of paper P, the following expression is obtained from FIG. 19B where $F_1$ is a conveyance force of the parting roller 6, $F_p$ is a conveyance force of the pickup roller 5, $F_2$ is a returning force of the retard roller 7, $F_3$ is a frictional force between sheets of paper P by the pressing force of the hopper 3*b*, and $F_4$ is a frictional force between the sheets of paper P by own weight of the first sheet of paper.

$$F_1+F_P>F_2+F_3+F_4$$

where $\mu_1$ is a coefficient of friction between the parting roller 6 and the sheet of paper P, $\mu_4$ is a coefficient of friction between the pickup roller 5 and the sheet of paper P, $\mu_p$ is a coefficient of friction between two adjacent sheets of paper, m is own weight of one sheet of paper P, and $P_p$ is a pressing force of the hopper 3*b*.

The above inequality is rewritten as the following expression (c).

$$Pr>(1/\mu_1)\times(T/r)+(1/\mu_1)\times\{(\mu_p-\mu_4)\times P_p+\mu_p\times m\} \quad (c)$$

(3) When two sheets of paper P lie between the parting roller 6 and the retard roller 7:

The sheets of paper P are returned toward the hopper 3*b* by the retard roller 7 contacted by the paper P against the frictional force exerted between the two adjacent sheets of paper P. As conditions therefor, the following expression is obtained from FIG. 19C where $F_3$ is a frictional force between sheets of paper P by the pressing force of the parting roller 6, $F_6$ is a frictional force between sheets of paper P by pressing force of the hopper 3*b*, $F_7$ is a frictional force between sheets of paper by own weight of the first sheet of paper P, $F_8$ is a returning force of the retard roller 7, $F_9$ is a frictional force between sheets of paper by the pressing force of the hopper 3*b*, and $F_{10}$ is a frictional force between sheets of paper P by own weight of the first to second sheets of paper.

$$F_8>F_5+F_6+F_7+F_8+F_9+F_{10}$$

Then, when this expression is rewritten by using Pr, $\mu$p, Pp and m introduced by the expression (c), the following expression results.

$$Pr<(1/\mu p)\times(T/r)-(2\times Pp+3\times m) \quad (d)$$

From the above conditional expressions, the pressing force Pr of the retard roller 7 against the parting roller 6 is determined with the lower limit being larger one of either the expression (a) or (b). Further, the expressions (c) and (d) are inequalities with Pr and Pp being variables, so that the relation in magnitude between Pr and Pp is determined by substituting into the expressions (c) and (d) numerical values of the critical setting torque of the torque limiter 7*b*, the coefficient of friction of the sheet of paper P used, and the like. Then, by specifying the value equal to or more than the lower limit of Pr specified by the expressions (a) or (b) in advance, the optimum value of Pp can be given as a maximum value within the range of relation in magnitude with respect to Pr.

In this manner, the conditions for optimizing the separation of sheets of paper by the parting roller 6 and the retard roller 7 from the paper feeding by the pickup roller 5 can be represented as the pressing force Pr of the retard roller 7 and the pressing force Pp of the hopper 3*b*. Then, these pressing forces Pr and Pp are determined by the biasing force of the torsion springs 13 and 8, respectively, so that it is possible to optimize the separation function of the paper feeding and the separation of the sheets of paper by rotationally operating the parting cam 14 and the hopper cam 9 for adjusting the biasing forces.

It is to be noted herein that the hopper cam 9 and the parting cam 14 are rotated at the same time by the adjusting dial 15*a* to change their postures and that such a construction maybe employed that each member can implement its function so as to satisfy the above conditions about Pr and Pp. That is, the biasing forces of the torsion springs 8 and 13 by the hopper cam 9 and the parting cam 14 can variously be adjusted by elements such as the forms of the peripheral surfaces of the hopper and parting cams 9 and 14, the direction and angle of rotation thereof, the spring constants of the torsion springs 8 and 13, gear ratios of the gears 216*a* to 216*c*, etc. Thus, as long as the maximum or minimum paper loading weight and the coefficient of friction for each paper quality meet the previously predicted design conditions, a paper feeder can be obtained which satisfies the conditions of optimum Pr and Pp for the paper feed and the paper separation.

For example, when the paper size is large, a larger mounting load is applied to the hopper 3*b*, resulting in the larger force depressing the hopper 3*b* around the pin 3*d*. Accordingly, in order to compensate for the pressing force on the pickup roller 5 by biasing upward the hopper 3*b* against the depressing force, the hopper cam 9 is set to assume the posture shown in FIG. 18A having a larger biasing force of the torsion spring 8. By virtue of this, even though the mounting load of the sheets of paper is large, the biasing force of the torsion spring is transmitted via the arm 4 to the hopper 3*b*, thereby abutting the sheets of paper on the hopper 3*b* against the pickup roller 5 by an appropriate pressing force. Reversely, when the paper size is small and its mounting load is also small, the hopper cam 9 can be rotated as shown in FIG. 18B to reduce the biasing force of the torsion spring 8. Accordingly, when the large sized paper is exchanged by the small sized paper, there is obtained a biasing force in conformity with the amounting load of the small sized paper by the invention although the posture of the hopper cam 9 shown in FIG. 18A may result in the excess biasing force.

Further, the pressing force of the retard roller 7 against the parting roller 6 is also optimized simultaneously with the adjustment of the pressing force of the hopper 3*b*. The adjustment of the pressing force aims mainly at preventing any overlap feeding due to the difference in the coefficient of friction based on the quality of paper, so that the overlap feeding can securely be prevented by ensuring that the parting cam 14 can fulfill its function so as to correspond to the relationship between the quality and size of sheets of paper used.

According to the present invention in this manner, regardless of difference in weight arising from the paper size or of the difference in the coefficient of friction due to quality of paper, it is possible to perform satisfactory feeding of paper and to prevent any overlap feeding of paper by adjusting the rotational posture of the hopper cam 9 and the parting cam 14 relative to the torsion springs 8 and 13 so as to be able to correspond to the various types of sheets of paper.

What is claimed is:

1. A paper feeding apparatus having a parting roller and a retard roller for preventing overlap feeding, which are disposed in pair above and below a pass line on which sheets of paper are fed one by one in order from the top of a stack of the sheets of paper, said retard roller being provided with a torque limiter between the retard roller and a spindle for driving the retard roller, said torque limiter being set so that its critical torque is bigger than a torque on a sliding friction force between sheets of paper nipped between the parting roller and the retard roller, wherein the paper feeding apparatus comprises a pressing force adjusting device which can vary a pressing force acting on the sheets of paper nipped between the parting roller and the retard roller by pressing the retard roller toward the parting roller, wherein said pressing force adjusting device includes a base which supports the spindle of the retard roller rotatably while keeping the retard roller parallel to the axis of the parting roller and which makes the retard roller movable in both the directions of contacting with and parting from the parting roller, a torsion spring which is disposed around a pivot shaft of the base and which has a hook at its one end connected to the base, and a cam which is engaged with a hook of the other end of the torsion spring and can set a tightening degree of the torsion spring in correspondence with a rotational posture thereof.

2. The paper feeding apparatus according to claim 1, wherein said cam is fixed to an adjusting shaft coupled to an adjusting dial which is disposed on the exterior of the paper feeding apparatus.

3. A paper feeding apparatus having a pickup roller disposed at the starting portion of a pass line on which sheets of paper are fed, a hopper which is disposed below the pickup roller and is operated so as to press the surface of the top of the sheets of paper carried thereon against the peripheral surface of the pickup roller, and an elastic member for pressing the hopper toward the pickup roller, wherein the paper feeding apparatus comprises a pressing force adjusting device which can vary a pressing force of the elastic member, wherein said hopper has a base end which faces the pickup roller and is rotatable along a vertical plane as a free end around the tip end and is supported by an arm for a rotational operation, wherein said elastic member includes a torsion spring which is disposed around the pivot shaft of the arm and has a hook at its one end connected to the arm, and wherein said pressing force adjusting device includes a cam which is engaged with a hook of the other end of the torsion spring and which can set a tightening degree of the torsion spring in correspondence with a rotational posture thereof.

4. The paper feeding apparatus according to claim 3, wherein said cam is fixed to an adjusting shaft coupled to an adjusting dial which is disposed on the exterior of the paper feeding apparatus.

5. A paper feeding apparatus having a pickup roller disposed at the starting portion of a pass line on which sheets of paper are fed, a hopper which is disposed below the pickup roller and is operated so as to press the surface of the top of the sheets of paper carried thereon against the peripheral surface of the pickup roller, and an elastic member for pressing the hopper toward the pickup roller wherein the paper feeding apparatus comprises a pressing force adjusting device which can vary a pressing force of the elastic member, and has a pair of guides which can be operated so as to move in the width direction of the hopper in conformity with the size of the sheets of paper carried on the hopper, wherein said pressing force adjusting device can adjust a load acting on the elastic member in correspondence with a movement of the pair of the guides so as to vary a pressing force between the hopper and the pickup roller.

6. The paper feeding apparatus according to claim 5, wherein said hopper has a base end which faces the pickup roller and which is rotatable along a vertical plane as a free end around the tip end, wherein said pressing force adjusting device includes a pinion arranged on the bottom side of the hopper, a pair of racks which is in mesh with the pinion while the tooth sides of the racks are opposed to each other and while the tooth lines of the racks are disposed in a direction of a movement of the guides, and a balance weight which is connected to the racks via a link mechanism and which can vary its position between the base end side and the tip end side of the hopper, wherein the load on the elastic member is adjusted by a movement of the balance weight which moves from the tip end side to the base end side of the hopper in correspondence with the guides moving toward each other and which moves from the base end side to the tip end side of the hopper in correspondence with the guides moving away from each other.

7. A paper feeding apparatus having a pickup roller disposed at the starting portion of a pass line on which sheets of paper are fed, a hopper which is disposed below the pickup roller and is operated so as to press the surface of the top of the sheets of paper carried thereon against the peripheral surface of the pickup roller, and an elastic member for pressing the hopper toward the pickup roller, wherein the paper feeding apparatus comprises a pressing force adjusting device which can vary a pressing force of the elastic member and has a parting roller and a retard roller for preventing overlap feeding, which are disposed in pair above and below a pass line on which the sheets of paper are fed one by one in order from the top of a stack of sheets of paper, wherein said pressing force adjusting device can simultaneously set the pressing forces between the hopper and the pickup roller and between the parting roller and the retard roller in a relation satisfying conditions to feed one sheet of paper and to restrict overlap feeding of two or more sheets of paper.

* * * * *